US007597091B2

(12) United States Patent
Suzuki et al.

(10) Patent No.: US 7,597,091 B2
(45) Date of Patent: Oct. 6, 2009

(54) AIR-FUEL RATIO CONTROL APPARATUS AND METHOD FOR AN INTERNAL COMBUSTION ENGINE

(75) Inventors: Yusuke Suzuki, Susono (JP); Yasushi Iwazaki, Ebina (JP); Toru Kidokoro, Hadano (JP); Hiroshi Sawada, Gotenba (JP); Fumihiko Nakamura, Susono (JP); Keiichiro Aoki, Numazu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 12/213,064

(22) Filed: Jun. 13, 2008

(65) Prior Publication Data

US 2009/0037079 A1 Feb. 5, 2009

Related U.S. Application Data

(63) Continuation-in-part of application No. 12/083,879, filed as application No. PCT/IB2006/003504 on Dec. 7, 2006.

(30) Foreign Application Priority Data

Dec. 8, 2005 (JP) ..... 2005-354450
Jul. 9, 2007 (JP) ..... 2007-180283
Jul. 24, 2007 (JP) ..... 2007-192474

(51) Int. Cl.
*F02D 41/14* (2006.01)

(52) U.S. Cl. ..... 123/673; 123/703; 701/103; 701/109

(58) Field of Classification Search ..... 123/672, 123/673, 703; 701/103, 109
See application file for complete search history.

(56) References Cited

U.S. PATENT DOCUMENTS

| | | | | |
|---|---|---|---|---|
| 4,125,374 | A | 11/1978 | Bode et al. | |
| 4,141,326 | A * | 2/1979 | Wolber | 123/684 |
| 5,259,189 | A | 11/1993 | Baier et al. | |
| 5,339,627 | A | 8/1994 | Baier | |
| 5,956,945 | A * | 9/1999 | Kumar et al. | 60/274 |
| 6,739,176 | B2 * | 5/2004 | Neuhausen et al. | 73/23.31 |
| 6,823,662 | B1 * | 11/2004 | Yamamoto et al. | 60/286 |
| 7,028,675 | B2 * | 4/2006 | Bushnell et al. | 123/546 |
| 7,380,546 | B2 * | 6/2008 | Bushnell et al. | 123/672 |

FOREIGN PATENT DOCUMENTS

| | | |
|---|---|---|
| DE | 101 15 902 C1 | 7/2002 |
| EP | 0 492 165 A2 | 7/1992 |
| EP | 0 530 655 A2 | 3/1993 |
| EP | 1 298 304 A2 | 4/2003 |
| JP | A-3-151544 | 6/1991 |
| JP | A-4-318250 | 11/1992 |
| JP | A-07-133738 | 5/1995 |
| JP | A-7-197837 | 8/1995 |
| JP | A-8-49585 | 2/1996 |
| JP | A-9-268934 | 10/1997 |

(Continued)

*Primary Examiner*—Erick Solis
(74) *Attorney, Agent, or Firm*—Oliff & Berridge, PLC

(57) ABSTRACT

When an internal combustion engine including a plurality of cylinders is operating steadily, an index value relating to an actual hydrogen content in exhaust gas downstream of a portion where exhaust passages from the cylinders merge, and upstream of a catalyst is detected. When an index value relating to the actual hydrogen content in the exhaust gas is larger than a determination index value relating to a hydrogen content corresponding to a permissible limit of air-fuel ratio variation, it is determined that there is abnormal air-fuel ratio variation between the cylinders.

4 Claims, 15 Drawing Sheets

FOREIGN PATENT DOCUMENTS

| | | |
|---|---|---|
| JP | B2-2689368 | 12/1997 |
| JP | A-11-247687 | 9/1999 |
| JP | A-2000-220489 | 8/2000 |
| JP | A-2002-47919 | 2/2002 |
| JP | A-2002-266682 | 9/2002 |
| JP | A-2003-120383 | 4/2003 |
| JP | A-2006-152845 | 6/2006 |
| JP | A-2006-291893 | 10/2006 |

* cited by examiner

FIG. 8A

EXAMPLE MAP

| | #1 | #2 | #3 | #4 |
|---|---|---|---|---|
| PATTERN 1 | 1.01 | 0.99 | 0.99 | 1.01 |
| PATTERN 2 | 1.02 | 0.98 | 0.98 | 1.02 |
| PATTERN 3 | 0.98 | 0.98 | 1.02 | 1.02 |
| ⋮ | ⋮ | ⋮ | ⋮ | ⋮ |

FIG. 8B

EXAMPLE MAP

| | #1 | #2 | #3 | #4 |
|---|---|---|---|---|
| PATTERN 1 | 0.98 | 1.006 | 1.006 | 1.006 |
| PATTERN 2 | 0.98 | 0.98 | 1.02 | 1.02 |
| PATTERN 3 | 0.98 | 0.98 | 0.98 | 1.06 |
| ⋮ | ⋮ | ⋮ | ⋮ | ⋮ |

AIR-FUEL RATIO CONTROL APPARATUS AND METHOD FOR AN INTERNAL COMBUSTION ENGINE

INCORPORATION BY REFERENCE

This is a Continuation-In-Part application of U.S. patent application Ser. No. 12/083,879 filed on Apr. 21, 2008, by Yusuke Suzuki, entitled "AIR-FUEL RATIO CONTROL APPARATUS AND METHOD FOR INTERNAL COMBUSTION ENGINE." U.S. patent application Ser. No. 12/083,879 is herein incorporated by reference in its entirety including all references disclosed therein. This application also claims priority to Japanese applications Nos. JP 2005-351210 filed on Dec. 8, 2005; JP 2007-180283 filed on Jul. 9, 2007; JP2007-192474 filed on Jul. 24, 2007. These Japanese applications are hereby incorporated by reference in their entirety including all references disclosed therein.

BACKGROUND OF THE INVENTION

1. Field of the Invention

The invention relates to an air-fuel ratio control apparatus and an air-fuel ratio control method for an internal combustion engine.

2. Description of the Related Art

The air-fuel ratio in an internal combustion engine must be accurately controlled for an exhaust gas control catalyst to be able to effectively purify the exhaust gas. In order to control the air-fuel ratio, the amount of fuel to be injected is calculated based on the intake air amount detected by an airflow meter or the like. Furthermore, the air-fuel ratio is also feedback-controlled by adjusting the fuel injection quantity based on the output of an air-fuel ratio sensor arranged in the exhaust passage.

The air-fuel ratio control described above does enable the air-fuel ratio of the overall internal combustion engine to be accurately controlled. However, even though the desired air-fuel ratio for the overall internal combustion engine can be obtained, when looking at the cylinders individually, air-fuel ratio variation occurs between cylinders due to differences in, for example, the intake air characteristics and the injection characteristics of the fuel injection valves.

If there is air-fuel ratio variation between cylinders, exhaust emissions deteriorate even if the air-fuel ratio for the overall internal combustion engine is the stoichiometric air-fuel ratio. Also, if there is air-fuel ratio variation between cylinders, the torque generated in each cylinder will be different, which may lead to torque fluctuation. Thus, it is desirable to detect and correct any air-fuel ratio variation between cylinders. When there is air-fuel ratio variation between cylinders, if the air-fuel ratio variation is small, the air-fuel ratio variation can be corrected by an air-fuel ratio feedback control, and a catalyst can purify pollutant components in exhaust gas, and therefore, a problem is not caused. However, when the air-fuel ratio variation between the cylinders is large, for example, due to a malfunction of a fuel injection system for a part of the cylinders, exhaust emissions deteriorate, and a problem is caused. It is preferable that the large air-fuel ratio variation that deteriorates the exhaust emissions should be detected as abnormal air-fuel ratio variation. Particularly, it is required to detect the abnormal air-fuel ratio variation between the cylinders in the internal combustion engine mounted in the vehicle, to prevent the vehicle from traveling when exhaust emissions from the vehicle deteriorate. Recently, there has been a movement for making it mandatory to detect the abnormal air-fuel ratio variation. Accordingly, when there is abnormal air-fuel ratio variation between the cylinders, it is preferable to detect the abnormal air-fuel ratio variation between the cylinders.

One conceivable method for detecting air-fuel ratio variation between cylinders is to arrange an air-fuel ratio sensor that detects the exhaust gas air-fuel ratio in each cylinder. Employing this method, however, greatly increases costs as it requires the same number of air-fuel ratio sensors as there are cylinders.

Japanese Patent No. 2689368 describes an apparatus which provides a single wide range air-fuel ratio sensor in a merging portion in the exhaust system, models the time that it takes (i.e., delay) for the air-fuel ratio sensor to detect the exhaust gas discharged from each of the cylinders, and estimates the air-fuel ratio of each cylinder by an observer.

According to the apparatus that estimates the air-fuel ratio of each cylinder described in Japanese Patent No. 2689368 above, the air-fuel ratio of each of a plurality of cylinders can be estimated with a single air-fuel ratio sensor. However, there are various limitations when it comes to employing the apparatus described in that publication.

One such limitation is that it requires that the gas transfer delay from each cylinder to the air-fuel ratio sensor be a constant delay. Therefore, the length of the exhaust manifold must be uniform for each cylinder. Designing an actual exhaust manifold shape so that it will satisfy this kind of limitation is difficult. In particular, making the length of the exhaust manifold uniform for each cylinder in a V-type engine is structurally near impossible.

Another limitation is that the exhaust gas from each cylinder must pass through the air-fuel ratio sensor in a state in which it is, to the greatest extent possible, not mixed with the exhaust gas from other cylinders. Therefore, the location where the air-fuel ratio can be mounted is limited to the merging portion (joining portion) in the exhaust system.

A third limitation is that the air-fuel ratio sensor must be sensitive to the exhaust gas coming from each cylinder that flows at extremely short intervals of time. That is, the air-fuel ratio sensor must be have extremely good (i.e., fast) responsiveness.

Various limitations such as those described above make it extremely difficult in actuality to adapt the apparatus that estimates the air-fuel ratio of each cylinder described in the foregoing publication.

SUMMARY OF THE INVENTION

It is an object of the invention to provide an air-fuel ratio control apparatus and an air-fuel ratio control method for an internal combustion engine with few design limitations and which can accurately correct, with a simple structure, air-fuel ratio variation between cylinders in an internal combustion engine having a plurality of cylinders.

A first aspect of the invention relates to an air-fuel ratio control apparatus of an internal combustion engine. The air-fuel ratio control apparatus includes hydrogen detection device and a determination portion. The hydrogen detection device is arranged downstream of a portion where exhaust passages from a plurality of cylinders merge, and detects an index value relating to an actual hydrogen content in exhaust gas. The determination portion determines whether air-fuel ratio variation between the cylinders is abnormal air-fuel ratio variation, by comparing the index value relating to the actual hydrogen content, with a determination index value relating to a hydrogen content corresponding to a permissible limit of the air-fuel ratio variation between the cylinders.

The hydrogen detection device may detect the index value relating to the actual hydrogen content in the exhaust gas in an area downstream of the portion where the exhaust passages from the cylinders merge, and upstream of a catalyst.

According to this structure, the index value relating to the actual hydrogen content in the mixed exhaust gas which is a mixture of the exhaust gases from the plurality of cylinders can be detected. One characteristic of the exhaust gas of the internal combustion engine is that the hydrogen content in the mixed exhaust gas increases, as air-fuel ratio variation between cylinders increases. Therefore, according to this structure, when the index value relating to the actual hydrogen content is larger than the determination index value relating to the hydrogen content corresponding to the permissible limit of the air-fuel ratio variation between the cylinders, it is determined that the air-fuel ratio variation between the cylinders is abnormal air-fuel ratio variation. Thus, it is possible to accurately detect abnormal air-fuel ratio variation between the cylinders. Also, according to this structure, only one hydrogen sensor and one air-fuel ratio sensor need to be provided for a plurality of cylinders, which is effective for reducing costs. In addition, there are no design limitations regarding the shape of the exhaust manifold or the responsiveness of the hydrogen sensor, which makes this structure easy to embody.

A second aspect of the present invention relates to an air-fuel ratio control apparatus of an internal combustion engine. The air-fuel ratio control apparatus includes a detection device that is arranged downstream of a portion where exhaust passages from a plurality of cylinders merge, and that detects a first sensor value in exhaust gas; and a determination portion that determines whether air-fuel ratio variation between the cylinders is abnormal air-fuel ratio variation, by comparing an index value relating to the actual hydrogen content calculated based on the first sensor value, with a determination index value relating to a hydrogen content corresponding to a permissible limit of the air-fuel ratio variation between the cylinders.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein:

FIGS. 8A and 8B are views of examples of injection ratio maps according to a second embodiment of the invention;

DETAILED DESCRIPTION OF THE PREFERRED EMBODIMENTS

Figure 1:
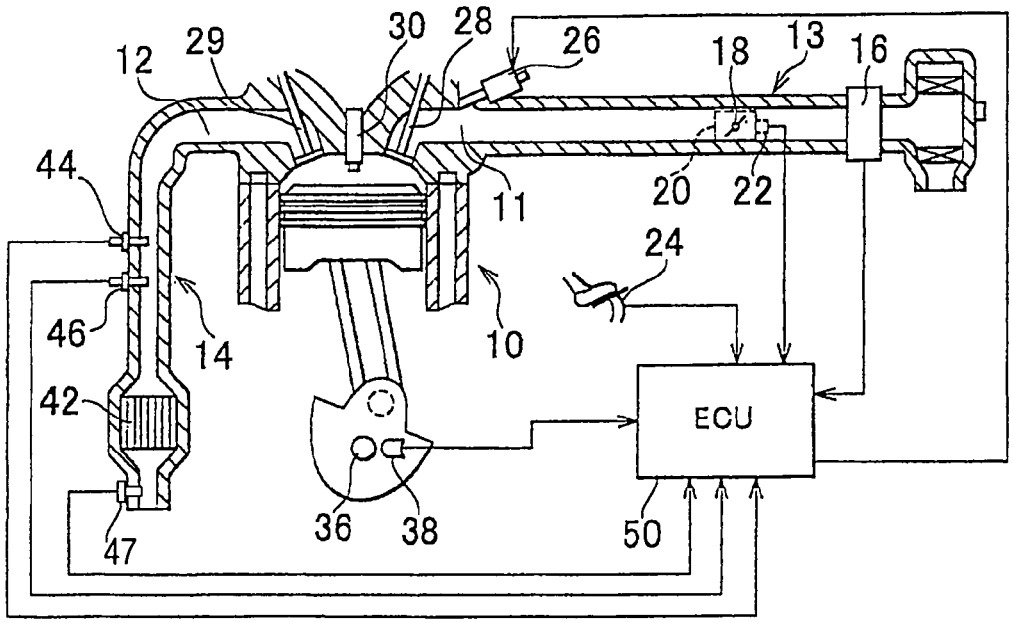
FIG. 1 is a diagram of the structure of a system according to a first embodiment of the invention.
Figure 2:
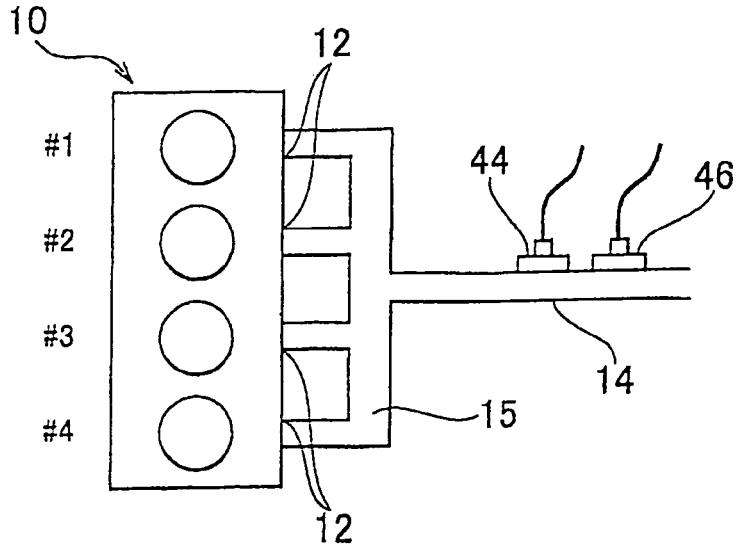
FIG. 2 is a plane view in frame format showing an internal combustion engine in the system shown in FIG. 1.

A first embodiment of the invention will now be described. First, the structure of a system according to the first embodiment will be described. FIG. 1 is a view showing the structure of the system according to the first embodiment of the invention. FIG. 2 is a plane view in frame format showing an internal combustion engine in the system shown in FIG. 1. As shown in FIG. 1, the system in this embodiment includes a four-cycle internal combustion engine 10 which has a plurality of cylinders. FIG. 1 shows a cross-section of one of those cylinders. In the following descriptor, the internal combustion engine 10 is an inline four-cylinder engine having four cylinders, denoted as #1, #2, #3, and #4.

Each cylinder of the internal combustion engine 10 is provided with an intake port 11 and an exhaust port 12. The intake port 11 of each cylinder is communicated with a single intake passage 13 via an intake manifold, not shown. Also, as shown in FIG. 2, the exhaust port 12 of each cylinder is communicated with a single exhaust passage 14 via an exhaust manifold 15.

An airflow meter 16 is arranged in the intake passage 13. This airflow meter 16 detects the amount of air flowing into the intake passage 13, i.e., the amount of intake air flowing into the internal combustion engine 10. A throttle valve 18 is arranged downstream of the airflow meter 16. This throttle valve 18 is an electronically controlled throttle valve that is driven by a throttle motor 20 based on an accelerator depression amount and the like. A throttle position sensor 22 that detects the throttle opening amount is arranged near the throttle valve 18. The accelerator depression amount is detected by an accelerator position sensor 24 provided near an accelerator pedal.

A fuel injection valve 26 for injecting a fuel such as gasoline is arranged in the intake port 11 of each cylinder. The internal combustion engine 10 is not limited to being a port injection engine as is shown in the drawing. It may also be an in-cylinder injection engine in which fuel is injected directly into the cylinders. Further, port injection and in-cylinder injection may also be combined.

Moreover, an intake valve 28 and an exhaust valve 29, as well as a spark plug 30 for igniting the air-fuel mixture in the combustion chamber are arranged in each cylinder.

A crank angle sensor 38 for detecting the rotation angle of a crankshaft 36 is provided near the crankshaft 36 of the internal combustion engine 10. The crank angle sensor 38 is a sensor that switches between a Hi output and a Lo output each time the crankshaft rotates a predetermined rotation angle. The rotational position of the crankshaft, as well as the engine speed NE and the like can be detected according to the output of the crankshaft sensor 38.

A catalyst 42 which purifies exhaust gas is arranged in the exhaust passage 14 of the internal combustion engine 10. An air-fuel ratio 44 and a hydrogen sensor 46 are arranged upstream of the catalyst. A downstream air-fuel ratio sensor 47 is provided downstream of the catalyst 42. Each of the air-fuel ratio sensor 44 and the downstream air-fuel ratio sensor 47 is a sensor that outputs a signal indicative of the air-fuel ratio of the exhaust gas passing by the location of the air-fuel ratio sensor 44. The hydrogen sensor 46 is a sensor that output a signal indicative of hydrogen ($H_2$) content ha the exhaust gas passing by the location of the hydrogen sensor 46.

As shown in FIG. 2, the air-fuel ratio sensor 44 and the hydrogen sensor 46 are arranged downstream of a joining portion (merging portion) of the exhaust manifold 15. Exhaust gas which is an even mixture of the exhaust gases discharged from each of the cylinders passes by the locations where the air-fuel ratio sensor 44 and the hydrogen sensor 46 are arranged. Hereinafter, this gas that is a mixture of the exhaust gases discharged from each of the cylinders will be referred to as "mixed exhaust gas".

Also, the system shown in FIG. 1 includes an ECU (Electronic Control Unit) 50 to which the various sensors and actuators described above are connected. The ECU 50 is able to control the operating state of the internal combustion engine 10 based on the outputs from those sensors.

Figure 3:
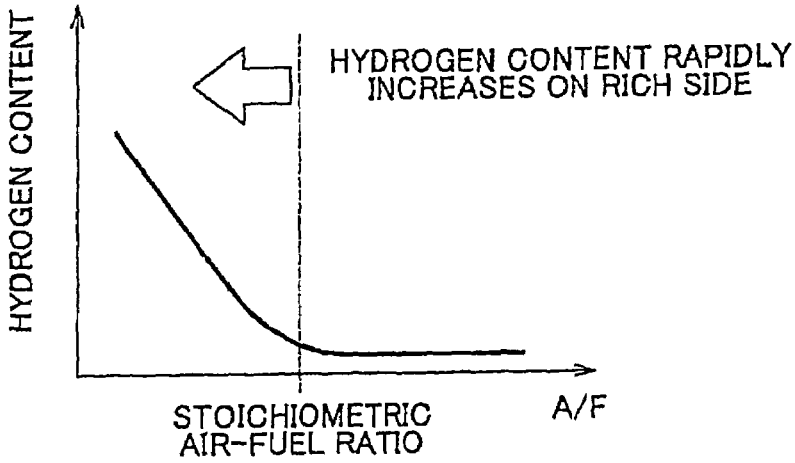
FIG. 3 is a graph showing the discharge characteristics of hydrogen from the internal combustion engine.

Here, the characteristics of the first embodiment will now be described. First, the discharge characteristics of hydrogen will be described. Typically, hydrogen gas is produced in the exhaust gas of the internal combustion engine by a combustion reaction between fuel and air. FIG. 3 shows the discharge characteristics of hydrogen from the internal combustion engine. In FIG. 3, the horizontal axis represents the air-fuel ratio of the air-fuel mixture supplied for combustion, while the vertical axis represents the hydrogen content in the exhaust gas. As shown in the drawing, the hydrogen content in the exhaust gas is close to zero on the lean side of the stoichiometric air-fuel ratio and rapidly increases the richer the air-fuel ratio with respect to the stoichiometric air-fuel ratio. In the system according to this embodiment, the hydrogen sensor 46 is able to detect the hydrogen content in the mixed exhaust gas.

Next, the overall air-fuel ratio control according to the first embodiment will be described. The system of this embodiment can calculate the fuel injection quantity necessary to achieve a desired air-fuel ratio based on the intake air amount detected by the airflow meter 16. Further, the air-fuel ratio can be feedback controlled by adjusting the fuel injection quantity based on the air-fuel ratio detected by the air-fuel ratio sensor 44. This kind of control enables the air-fuel ratio of the overall internal combustion engine 10 (hereinafter simply referred to as "overall air-fuel ratio") to be accurately controlled. When controlling the overall air-fuel ratio, the overall air-fuel ratio is normally controlled to the stoichiometric air-fuel ratio in order to have the catalyst 42 effectively purify the exhaust gas. In the following description, the ECU 50 controls the overall air-fuel ratio so that it becomes the stoichiometric air-fuel ratio.

Next, air-fuel ratio variation between cylinders will be described. As described above, in this embodiment, the overall air-fuel ratio can be accurately controlled to the stoichiometric air-fuel ratio. However, in the internal combustion engine 10 having a plurality of cylinders, the lengths and shapes of the intake pipes are generally not all exactly the same so the in-cylinder intake air amounts in all of the cylinders are not exactly the same. Also, individual differences in the characteristics of the fuel injection valves 26 result in the fuel injection quantities not all being exactly the same for all of the cylinders. Therefore, even if the overall air-fuel ratio is controlled to the stoichiometric air-fuel ratio, there is still usually some air-fuel ratio variation between cylinders. In this embodiment, air-fuel ratio variation between cylinders can be reduced based on the output of the hydrogen sensor 46, as will be described below.

Figure 4:
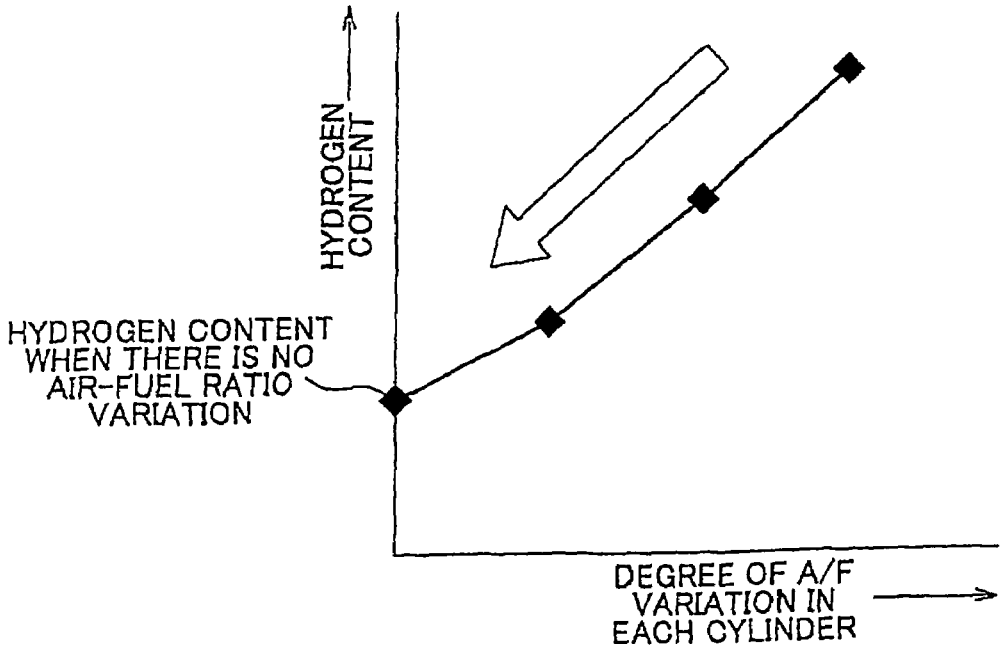
FIG. 4 is a graph showing the relationship between the hydrogen content in mixed exhaust gas and the degree of air-fuel ratio variation between cylinders.

FIG. 4 is a graph showing the relationship between the hydrogen content in the mixed exhaust gas and the degree of air-fuel ratio variation between cylinders. As described above, in this embodiment, the hydrogen sensor 46 can detect the hydrogen content in the mixed exhaust gas which is the combined exhaust gases from all of the cylinders.

Should there be air-fuel ratio variation between cylinders when the overall air-fuel ratio is controlled to the stoichiometric air-feel ratio, the air-fuel ratio in some cylinders will be lean (these cylinders may also be referred to here as "lean cylinders") while the air-fuel ratio in other cylinders will be rich (these cylinders may also be referred to here as "rich cylinders"). Hydrogen is discharged from those cylinders with rich air-fuel ratios. Therefore, in this case, because the mixed exhaust gas contains a certain amount of hydrogen, the hydrogen content detected by the hydrogen sensor 46 also increases somewhat. The larger the degree of air-fuel ratio variation between cylinders, the richer the rich cylinders become. As a result the amount of hydrogen discharged increases even more, thus increasing the hydrogen content in the mixed exhaust gas.

In contrast, when the overall air-fuel ratio is controlled to the stoichiometric air-fuel ratio and there is no air-fuel ratio variation between cylinders, i.e., when the air-fuel ratios of the exhaust gases discharged from all of the cylinders are all correctly the stoichiometric air-fuel ratio, almost no hydrogen is discharged from any of the cylinders. In this case, therefore, the hydrogen content in the mixed exhaust gas should be extremely low.

From the above comes the following relationship, as shown in FIG. 4: the hydrogen content in the mixed exhaust gas increases the greater the degree of air-fuel ratio variation between cylinders. Using this relationship it is possible to search for a state in which the air-fuel ratio variation between cylinders is low. That is, during steady operation, the fuel injection quantity ratio in each cylinder is gradually changed while maintaining the overall air-fuel ratio at the stoichiometric air-fuel ratio. This process will be referred to as an "injection ratio changing process". While this injection ratio changing process is being executed, the hydrogen content is successively detected by the hydrogen sensor 46. The injection ratio when the lowest hydrogen content is detected is determined to be the injection ratio with the least air-fuel ratio variation between the cylinders.

Figures 5A, 5B, 5C:
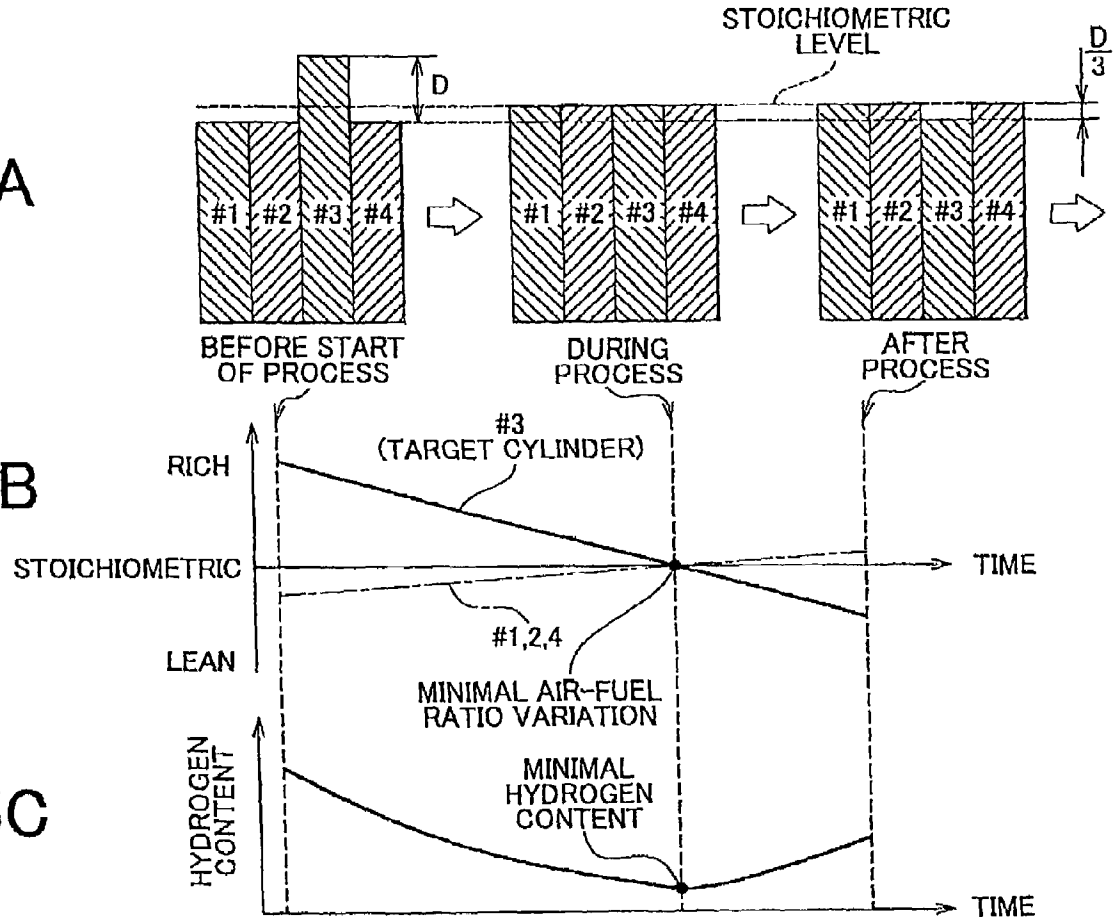
FIG. 5 is a view illustrating a method according to an injection ratio changing process according to the first embodiment.

FIG. 5 is a view illustrating a method of the injection ratio changing process in this embodiment. The bar graph in FIG. 5A indicates the fuel injection quantity in each of cylinders #1 to #4 before, during, and after the injection ratio changing process. Also, FIG. 5B shows the change in the air-fuel ratio by cylinder during execution of the injection ratio changing process. FIG. 5C shows the change in the hydrogen content in the mixed exhaust gas during execution of the injection ratio changing process.

In the injection ratio changing process of this embodiment, any one cylinder is selected (hereinafter this selected cylinder may also be referred to as the "target cylinder") and the fuel injection quantity for that cylinder is then gradually increased or decreased. At the same time, the fuel injection quantities of the other cylinders are decreased or increased to keep the overall air-fuel ratio constant.

The examples shown in FIGS. 5A to 5C illustrate a case in which the #3 cylinder is the target cylinder. Here, as shown in the bar graph on the left side in FIG. 5A, before the injection ratio changing process starts, the fuel injection quantity of the #3 cylinder is increased beyond the stoichiometric air-fuel ratio level while the fuel injection quantities of the #1, #2, and #4 cylinders are decreased below the stoichiometric air-fuel ratio by a corresponding amount such that the sum of the decrease amounts of the fuel injection quantities of the #1, #2, and #4 cylinders below the stoichiometric air-fuel ratio is equal to the increase amount of the fuel injection quantity of the #3 cylinder above the stoichiometric air-fuel ratio. To simplify the description, the fuel injection quantities of the #1, #2, and #4 cylinders are all made the same. Before the process starts to be executed, the fuel injection quantity of the #3 cylinder is greater than the fuel injection quantities of the #1, #2, and #4 cylinders by a predetermined amount "D".

Before the process starts, only the #3 cylinder is rich, as shown in FIG. 5B, so hydrogen is discharged from that #3 cylinder. Therefore, the hydrogen content in the mixed exhaust gas is relatively high, as shown in FIG. 5C.

From this state, the fuel injection quantity of the #3 cylinder is gradually reduced and the fuel injection quantities of the #1, #2, and #4 cylinders are each increased by one-third the amount by which the fuel injection quantity of the #3 cylinder was decreased. As a result, the overall fuel injection quantity is kept constant so the overall air-fuel ratio is also kept constant.

When the fuel injection quantity of each cylinder is gradually changed in the manner described above, the air-fuel ratio of the #3 cylinder approaches the stoichiometric air-fuel ratio, as shown in FIG. 5B. Therefore, the amount of hydrogen discharged from the #3 cylinder decreases. On the other hand, the #1, #2, and #4 cylinders are still lean and thus discharge almost no hydrogen. As a result, the hydrogen content in the mixed exhaust gas decreases as the amount of hydrogen discharged from the #3 cylinder decreases.

When the fuel injection quantity of the #3 cylinder and the fuel injection quantities of the #1, #2, and #4 cylinders become equal, all of the cylinders are at the stoichiometric air-fuel ratio, as shown in the bar graph in the center of FIG. 5A. At this time, almost no hydrogen is discharged from any of the cylinders so the hydrogen content in the mixed exhaust gas is at its lowest.

If the fuel injection quantity of each cylinder is changed beyond this state, the fuel injection quantity of the #3 cylinder becomes less than the stoichiometric air-fuel ratio level and the fuel injection quantities of the #1, #2, and #4 cylinders become greater than the stoichiometric air-fuel ratio level. When this happens, hydrogen starts to be discharged from the #1, #2, and #4 cylinders so the hydrogen content in the mixed exhaust gas reverses and starts to increase.

Once the change ratio of the fuel injection quantity of the #3 cylinder has reached a predetermined value, the injection ratio changing process described above ends. When the routine ends, the fuel injection quantity of the #3 cylinder is less than the fuel injection quantities of the #1, #2, and #4 cylinders by an amount equal to "D/3", as shown in the bar graph on the right side in FIG. 5C.

As described above, the injection ratio when the hydrogen content in the mixed exhaust gas is minimal during the injection ratio changing process corresponds to an injection ratio at which there is the least air-fuel ratio variation between cylinders. Therefore, in this embodiment, the fuel injection quantity ratio of each cylinder when the hydrogen content in the mixed exhaust gas is minimal (hereinafter referred to as the "optimal injection ratio") is stored. After the injection ratio changing process ends, the current fuel injection ratio of each cylinder is corrected to the stored optimal injection ratio. As a result, the air-fuel ratio variation between the cylinders can be corrected.

In the example shown in FIGS. 5A to 5C, the fuel injection quantities of the #1, #2, and #4 cylinders are all equal before the injection ratio change routine is started. Therefore, the air-fuel ratio variation between the cylinders was able to be reduced to almost zero performing the injection ratio changing process with only the #3 cylinder as the target cylinder. In contrast, when the fuel injection quantity of each cylinder varies before the injection ratio changing process starts, the air-fuel ratio variation between the cylinders can be reduced to almost zero by performing the injection ratio changing process with each cylinder being selected sequentially as the target cylinder.

Figure 6:
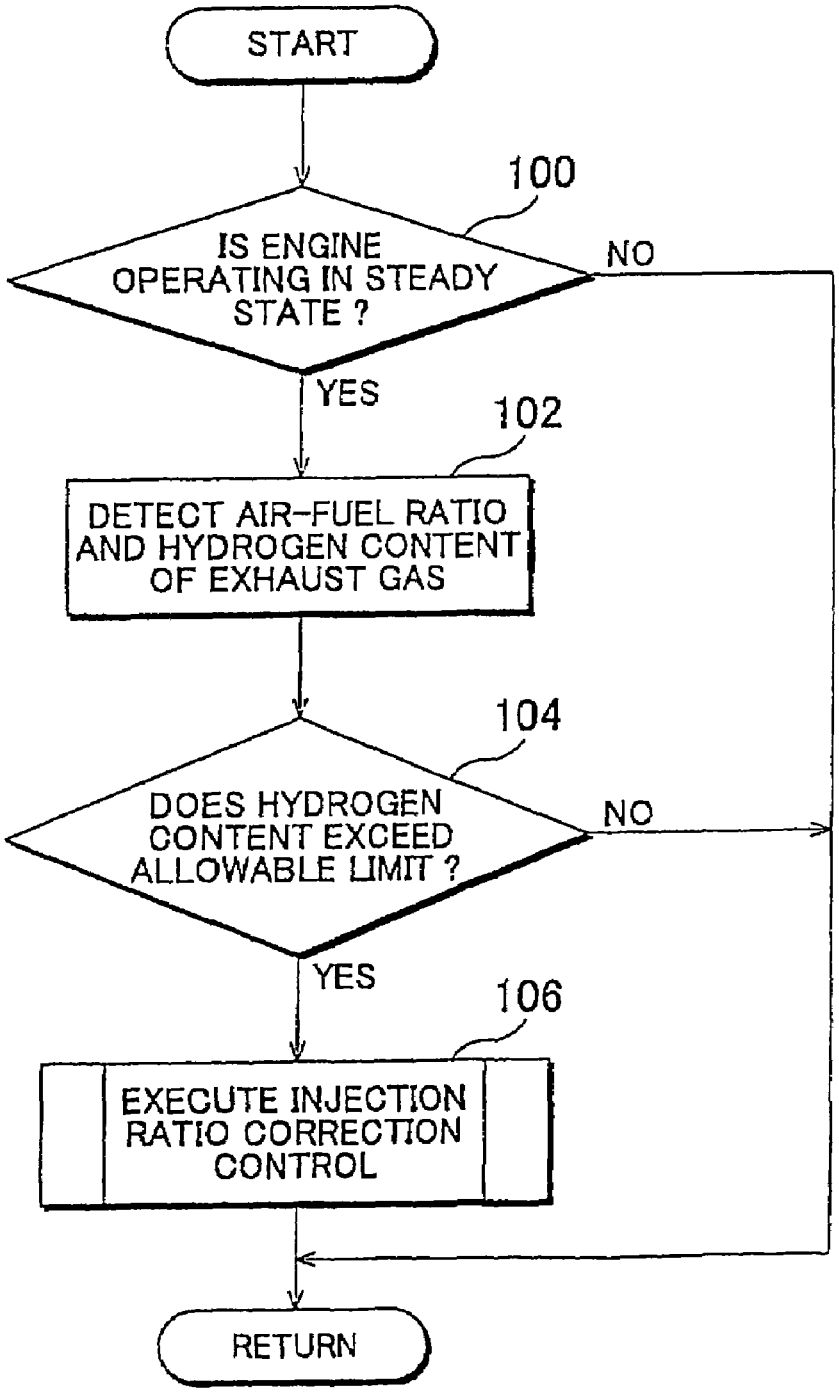
FIG. 6 is a flowchart illustrating a routine executed in the first embodiment of the invention.
Figure 7:
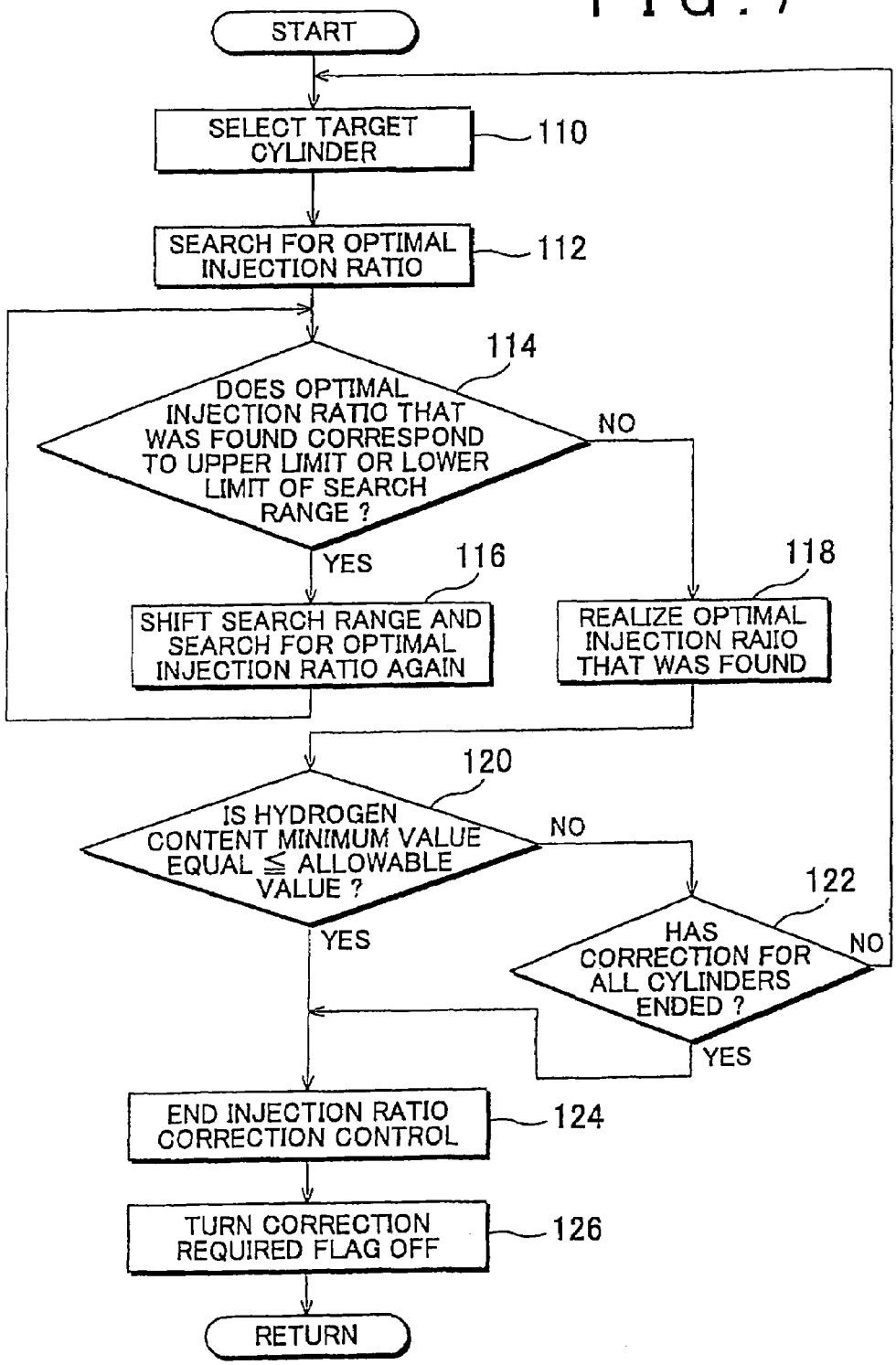
FIG. 7 is a flowchart of subroutine executed in the first embodiment of the invention.

Next, the detailed routine in the first embodiment will be described FIGS. 6 and 7 are flowcharts of routines executed by the ECU 50 in this embodiment in order to realize the foregoing function. The routine shown in FIG. 6 is executed when an injection ratio correction required flag, to be described later, is on.

According to the routine shown in FIG. 6, it is first determined whether the internal combustion engine 10 is operating steadily (step 100). More specifically, it is determined whether changes over time in each of the engine speed NE, load factor (air amount), and control target air-fuel ratio are within a predetermined range in which they may essentially be considered constant. The load factor can be calculated based on the throttle opening amount or intake pipe negative pressure.

During excessive operation of the internal combustion engine 10, the air-fuel ratio tends to change instantaneously so this is not an appropriate time to perform control for correcting air-fuel ratio variation between the cylinders. Therefore, when it is determined in step 100 that the internal combustion engine 10 is not operating steadily, control to correct air-fuel ratio variation is not performed and this cycle of the routine directly ends.

If, on the other hand, it is determined in step 100 that the internal combustion engine 10 is operating steadily, then the air-fuel ratio sensor 44 detects the overall air-fuel ratio and the hydrogen sensor 46 detects the hydrogen content in the mixed exhaust gas (step 102).

Next, it is determined whether the hydrogen content detected in step 102 exceeds a permissible hydrogen content for the overall air-fuel ratio detected in step 102 (step 104). Here, the permissible hydrogen content is a hydrogen content value that corresponds to an allowable limit of the degree of air-fuel ratio variation between the cylinders. This permissible hydrogen content differs depending on the value of the overall air-fuel ratio. A map or an operational expression which defines the relationship between the overall air-fuel ratio value and the permissible hydrogen content corresponding to that overall air-fuel ratio value is stored in the ECU 50. The above determination is made in step 104 referring to that map or operational expression after the permissible hydrogen content for the detected overall air-fuel-ratio has been obtained.

If the hydrogen content detected by the hydrogen sensor 46 is equal to or less than the permissible hydrogen content in step 104, it can be determined that the degree of air-fuel ratio variation between cylinders even in the current state is within allowable limits. In this case, there is no need to perform control to correct the air-fuel ratio variation so this cycle of the routine directly ends. If, on the other hand, the detected hydrogen content exceeds the permissible hydrogen content, control to correct the injection ratio (hereinafter also referred to as "injection ratio correction control") is performed in order to correct the air-fuel ratio variation between the cylinders (step 106).

When the detected hydrogen content in the mixed exhaust gas, which is an index value relating to the actual hydrogen content, is larger than a determination index value relating to a hydrogen content corresponding to a permissible limit of the air-fuel ratio variation, it is determined that the air-fuel ratio variation between the cylinders is abnormal air-fuel ratio variation in the internal combustion engine mounted in the vehicle. Thus, when the index value relating to the actual hydrogen content is larger than the determination index value relating to the hydrogen content corresponding to the permissible limit of the air-fuel ratio variation, it is determined that there is abnormal air-fuel ratio imbalance between the cylinders. In this embodiment, in step 106, when an index value relating to the actual hydrogen content is larger than a determination index value relating to a hydrogen content corresponding to a permissible limit of the air-fuel ratio variation, the ECU 50 determines that there is abnormal air-fuel ratio imbalance (variation) between the cylinders. "The determination portion" according to the first aspect may be implemented by the ECU 50. "The hydrogen detection device" according to the first aspect may be implemented by the hydrogen sensor 46.

In step 106, the subroutine shown in FIG. 7 is executed. First, the target cylinder of the injection ratio changing process is selected (step 110). More specifically, if the injection ratio changing process is to be performed in order from the #1 cylinder to the #4 cylinder, for example, the #1 cylinder is first selected. Then in step 110 of the next cycle, the #2 cylinder is selected and so on and so forth.

Also, if the control to correct air-fuel ratio variation was interrupted during the last cycle, and consequently not completed, the cylinder that was the target cylinder when the control was interrupted may be selected first in the next cycle.

Next, the optimal injection ratio is searched for with the cylinder selected in step 110 as the target cylinder (step 112). In step 112, the injection ratio changing process is first executed. This injection ratio changing process is a process like that described with reference to FIGS. 5A to 5C. That is, the fuel injection quantity of the target cylinder is gradually changed while the fuel injection quantities of the other cylinders are changed in an inverse manner in order to keep the overall air-fuel ratio (i.e., overall fuel injection quantity) constant.

At this time, the change range of the fuel injection quantity of the target cylinder (hereinafter referred to as the "search range") is a predetermined range (within ±5%, for example) centered around the fuel injection quantity before the start of the search. The predetermined range is set in advance according to a presumable degree of air-fuel ratio variation. Alternatively, the degree of air-fuel ratio variation from the hydrogen content detected before the start of the search may be estimated and the fuel injection quantity of the target cylinder changed within a range that includes that degree of air-fuel ratio variation.

While the fuel injection quantity of the target cylinder is gradually being changed in the manner described above, the hydrogen sensor 46 successively detects the hydrogen content and the injection ratio of the target cylinder when the hydrogen content is the lowest is stored in step 112.

Next, it is determined whether the injection ratio stored in step 112 corresponds to either an upper limit or a tower limit of the search range (step 114). If the determination is positive, it can be determined that the optimal injection ratio at which the hydrogen content is minimal is outside of the search range. In this case therefore, the search range is shifted and a search is conducted again for the optimal injection ratio, just as in step 112 (step 116). For example, if the last search range was a range of ±5% and the injection ratio at which the hydrogen content is minimal corresponded to an upper limit value (+5%) of that search range, then the new search range in step 116 is set at +5 to +15%. Conversely, if the injection ratio at which the hydrogen content is minimal corresponded to a lower lit value (−5%) of the search range, then the new search range is set at −5 to −15%.

When step 116, i.e., the repeat search for the optimal injection ratio, is executed, step 114 is executed again. That is, in the repeat search for the optimal injection ratio, it is determined whether the injection ratio stored for the minimal hydrogen content corresponds to either the upper limit or the lower limit of the search range.

On the other hand, if it is determined in step 114 that the injection ratio stored for the minimal hydrogen content does not correspond to either the upper limit or the lower limit of the search range in the search for the optimal injection ratio, then it can be determined that the stored injection ratio is the optimal injection ratio. In this case, therefore, the current injection ratio for each cylinder is corrected to the optimal injection ratio (step 118). This step achieves the optimum injection ratio and thus reduces air-fuel ratio variation between the cylinders.

Next, it is determined whether a hydrogen content minimum value found in the optimal injection ratio search is equal to or less than the permissible hydrogen content (step 120). This permissible hydrogen content is the same value as was described with respect to step 104 above.

If in step 120 the hydrogen content minimum value exceeds the permissible hydrogen content, it can be determined that the air-fuel ratio variation between cylinders is still out of the allowable limits. In this case, it is then determined whether the optimal injection ratio search and injection ratio correction for all of the cylinders has ended (step 122). If there is still a cylinder that has not yet been designated as a target cylinder, steps 110 and thereafter are performed again. As a result, another optimal injection ratio search and injection ratio correction are performed with one of the remaining cylinders as the target cylinder.

If, on the other hand, it is determined in step 120 that the hydrogen content minimum value is equal to or less than the permissible hydrogen content, it can be determined that the air-fuel ratio variation between cylinders has already been corrected to equal to or less than the allowable limit. In this case, there is no need to perform an optimal injection ratio search with the remaining cylinders designated as the target cylinder so this cycle of the injection ratio correction control ends (step 124). Incidentally, when it is determined in step 122 that the optimal injection ratio search and injection ratio correction for all of the cylinders has ended, no further injection ratio correction is necessary so this cycle of the injection ratio correction control ends (step 124).

Once the injection ratio correction control ends, the injection ratio correction required flag turns off (step 126). The injection ratio correction required flag is turned on again after a predetermined period of time (e.g., after running a predetermined distance) by a step in another routine. When the injection ratio correction required flag is turned on, the routine shown in FIG. 6 is allowed to be executed. This enables the injection ratio correction control to be performed on a timely basis and not unnecessarily.

In this embodiment, executing injection ratio correction control like that described above enables air-fuel ratio variation between cylinders to be reduced, thereby improving exhaust emissions.

In particular, in this embodiment, searching for the optimal injection ratio for another cylinder when the cylinders are designated one by one as the target cylinder enables air-fuel ratio variation between the cylinders to be accurately corrected.

In the first embodiment described above, the injection ratio changing process in step 112 may also be regarded as an "injection ratio changing portion", and the process of storing the optimal injection ratio in step 112 and the process in step 118 may also be regarded as an "injection ratio correcting portion".

Also in the first embodiment described above, the process in step 114 may be regarded as an "injection ratio storing portion", the process in step 118 may be regarded as a "correcting portion", and the process in step 104 may be regarded as an "allowing portion".

Next, a second embodiment of the invention will be described with reference to FIGS. 8A, 8B and 9. The following description will focus on the differences between the embodiment described above so parts that are the same will be omitted or simplified. The system according to this embodiment can be realized by the ECU 50 executing the routines shown in FIG. 6 and FIG. 9, which will be described later, using the hardware structure shown in FIGS. 1 and 2.

This embodiment differs from the first embodiment in the manner in which the injection ratio changing process is performed. In this embodiment, when searching for the optimal injection ratio, the injection ratio of each cylinder is changed according to an injection ratio map that specifies a plurality of injection ratio patterns. FIGS. 8A and 8B each show an example of an injection ratio map.

As shown in FIGS. 8A and 8B, many injection ratio patterns are prepared in the injection ratio maps. Each injection ratio pattern includes four coefficients indicating injection ratios for the #1 to #4 cylinders. When performing the injection ratio changing process, the injection ratio patterns are selected one by one from an injection ratio map. A coefficient specified in the selected injection ratio pattern is then multiplied by the fuel injection quantity for each cylinder that was calculated by overall air-fuel ratio control, and the resulting fuel injection quantity is then injected from the fuel injection valve 26 of each cylinder as the fuel injection quantity for each cylinder.

While the injection ratio pattern is being sequentially switched in this way, the hydrogen sensor 46 detects the hydrogen content and a search for the optimal injection ratio pattern having the lowest hydrogen content is conducted. The optimal injection ratio pattern is a pattern of injection ratios in which the air-fuel ratio variation between cylinders is the lowest. Therefore, air-fuel ratio variation between cylinders can then be corrected by using that optimal injection ratio pattern.

The average value of the four coefficients of the injection ratio pattern in the injection ratio map is 1.0. Therefore, even if the injection ratio pattern changes, the total injection quantity is constant so the overall air-fuel ratio can be kept constant.

In the first embodiment, optimization for each cylinder is performed by designating the cylinders one by one as a target cylinder and gradually changing the injection ratio thereof. In contrast, in this embodiment, optimization can be performed simultaneously for all of the cylinders. Also, the best pattern is selected from among a limited number of injection ratio patterns so the optimal injection ratios can be found quickly.

From the viewpoints of improving the accuracy of air-fuel ratio variation correction and making the correction control faster, the injection ratio map preferably includes a large number of variation patterns that are likely to occur, according to the tendency of the air-fuel ratio variation obtained empirically.

For example, in terms of intake characteristics of the internal combustion engine 10, when it is learned that the intake characteristics of the #2 and #3 cylinders tend to become comparatively worse, the amount of air in the #2 and #3 cylinders tends to decrease so it can be assumed that those cylinders easily become rich. In this case, as shown in FIG. 8A, it is preferable that the injection ratio map include a large number of patterns in which the injection coefficients for the #2 and #3 cylinders are less than those for the #1 and #4 cylinders.

In the injection ratio map shown in FIG. 8A, each injection ratio pattern is set with the injection coefficients for the cylinders changing in steps of approximately 1% (i.e., 0.01). This step width is not limited to 1%, however. For example, when it is evident beforehand that the hydrogen content in the mixed exhaust gas is essentially unaffected unless the air-fuel ratio variation between cylinders is equal to or greater than 2%, the step widths of the injection ratio patterns may be set at 2% (i.e., 0.02).

Figure 9:
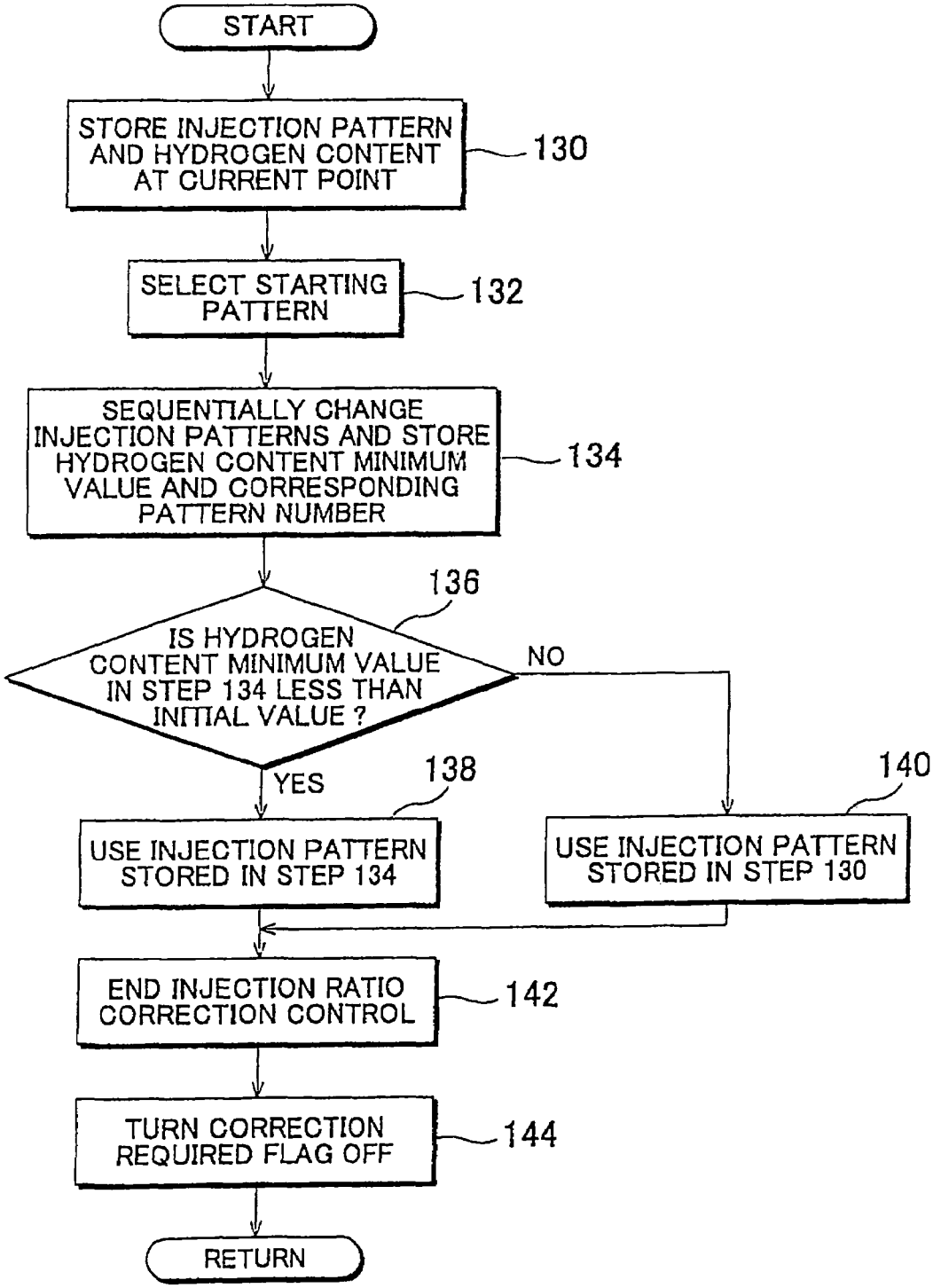
FIG. 9 is a flowchart illustrating a routine executed in the second embodiment of the invention.

FIG. 9 is a flowchart of a routine executed by the ECU 50 in this embodiment in order to realize the function described above. In this embodiment, when executing the process in step 106 in the routine shown in FIG. 6 described above, the subroutine shown in FIG. 9 is executed instead of the subroutine shown in FIG. 7 described above.

In the routine shown in FIG. 9, first, the number of the injection ratio pattern being used and the hydrogen content detected by the hydrogen sensor 46 at the current point, i.e., before the injection ratio correction is executed, are stored (step 130). Next, the injection ratio pattern to be selected first is selected from the injection ratio map when starting the injection ratio changing process (step 132). The starting pattern selected here may be the first pattern in a sequence in the injection ratio map when the injection ratio correction control is newly performed. Also, when returning to injection ratio correction control that was interrupted during the last cycle, the pattern that was being used when the control was interrupted may be selected.

Next, the injection ratio patterns in the injection ratio map are then selected in order starting from the starting pattern selected in step 132 (step 134). The selected injection ratio pattern is reflected in the current fuel injection quantity of each cylinder. Also, in step 134, while the fuel injection ratio for each cylinder is being sequentially changed according to the injection ratio map, the hydrogen sensor 46 successively detects the hydrogen content and the content value when the hydrogen content is the lowest, as well as the number of the injection ratio pattern at that time are stored.

When all of the patterns in the injection ratio map have been selected or when the process in step 134 has been interrupted due to, for example, the operating state of the internal combustion engine 10 shifting from a steady state to an excessive state, it is then determined whether the hydrogen content minimum value stored in step 134 is lower than the initial hydrogen content stored in step 130 (step 136). If the hydrogen content minimum value in step 134 is lower, it can be determined that the air-fuel ratio variation is lower with the injection ratio pattern in step 134 than it is with the initial injection ratio pattern. In this case, therefore, the injection ratio pattern stored in step 134 is used to calculate the fuel injection quantity for each cylinder thereafter (step 138).

If, on the other hand, the initial hydrogen content is lower in step 136, then it can be determined that the air-fuel ratio variation is lower with the initial injection ratio pattern stored in step 130. In this case, therefore, the initial injection ratio pattern stored in step 130 is used to calculate the fuel injection quantity of each cylinder thereafter (step 140).

After the fuel injection quantity has been calculated in either step 138 or step 140, this cycle of the injection ratio correction control ends (step 142). Even if initially there is air-fuel ratio variation between cylinders, this injection ratio correction control can correct that variation.

Once the injection ratio correction control ends, the injection ratio correction required flag turns off (step 144). The injection ratio correction required flag is turned on again after a predetermined period of time by a step in another routine, just as in the first embodiment.

In the second embodiment described above, the process of sequentially changing the injection ratio pattern in step 134 may also be regarded as an "injection ratio changing portion", and the process of storing the injection ratio pattern when the hydrogen content is lowest in step 134, together with the process in step 138 may also be regarded as an "injection ratio correcting portion".

Also in the second embodiment described above, the process in step 134 may also be regarded as an "injection ratio storing portion" and the process in step 138 may also be regarded as a "correcting portion". Further, the ECU 50 may also be regarded as a "pattern storing portion".

Next, a third embodiment of the invention will be described with reference to FIG. 10. The following description will focus on the differences between the embodiment described above so parts that are the same will be omitted or simplified.

In this embodiment, when there is a failure in the output value of the hydrogen sensor 46, control for detecting that failure may also be executed in addition to the control of the first or second embodiment. This embodiment can be realized by additionally executing the routine shown in FIG. 10 in the system of the first or second embodiment.

The hydrogen sensor 46 is placed in a harsh environment in which it is constantly exposed to exhaust gas, for example, just like the air-fuel ratio sensor 44. Therefore, there is a possibility that a failure resulting in an abnormally high or low output may occur in the hydrogen sensor 46. Even if an output failure does occur, the sensor often still remains sensitive to the hydrogen content.

Even if there is an output value failure in the hydrogen sensor 46, as long as the sensor remains sensitive to the hydrogen content, it is possible to perform control to correct the air-fuel ratio variation according to the first or the second embodiment. This is because in the first and second embodiments, even if the absolute value of the hydrogen content is not precisely known, it is sufficient to search for a state in which the hydrogen content is relatively low.

However, if the output from the hydrogen sensor 46 is used in other control (such as correction control for the air-fuel ratio sensor 44 or overall air-fuel ratio control or the like) and there is a failure in the output value from that hydrogen sensor 46, it may distort the other control in which it is used. Therefore, in this embodiment, a method such as that described below is used to detect a failure in the output value of the hydrogen sensor 46.

There is a relationship, as shown in FIG. 4 described above, between the degree of air-fuel ratio variation between cylinders and the hydrogen content in the mixed exhaust gas. That is, the hydrogen content is lower the less air-fuel ratio variation there is such when there is no air-fuel ratio variation, the hydrogen content converges with a given fixed hydrogen content. On the other hand, after the control is executed to correct the air-fuel ratio variation according to the first or second embodiment, there is almost no air-fuel ratio variation. Therefore, after the control has been executed to correct the air-fuel ratio variation, the hydrogen content in the exhaust gas should fall into a fixed range, depending on the operating conditions of the internal combustion engine 10 of course. As long as the hydrogen sensor 46 is operating normally, its output value should also fall into a fixed range.

Thus, in this embodiment, a normal range for the output value of the hydrogen sensor 46 is set in advance according to the operating conditions (the engine speed NE, the load factor, and the control target air-fuel ratio) of the internal combustion engine 10. Then, if after the control to correct the air-fuel ratio variation has been executed the output value of the hydrogen sensor 46 is out of that normal range, it is determined that there is a failure in the output value of the hydrogen sensor 46.

Figure 10:
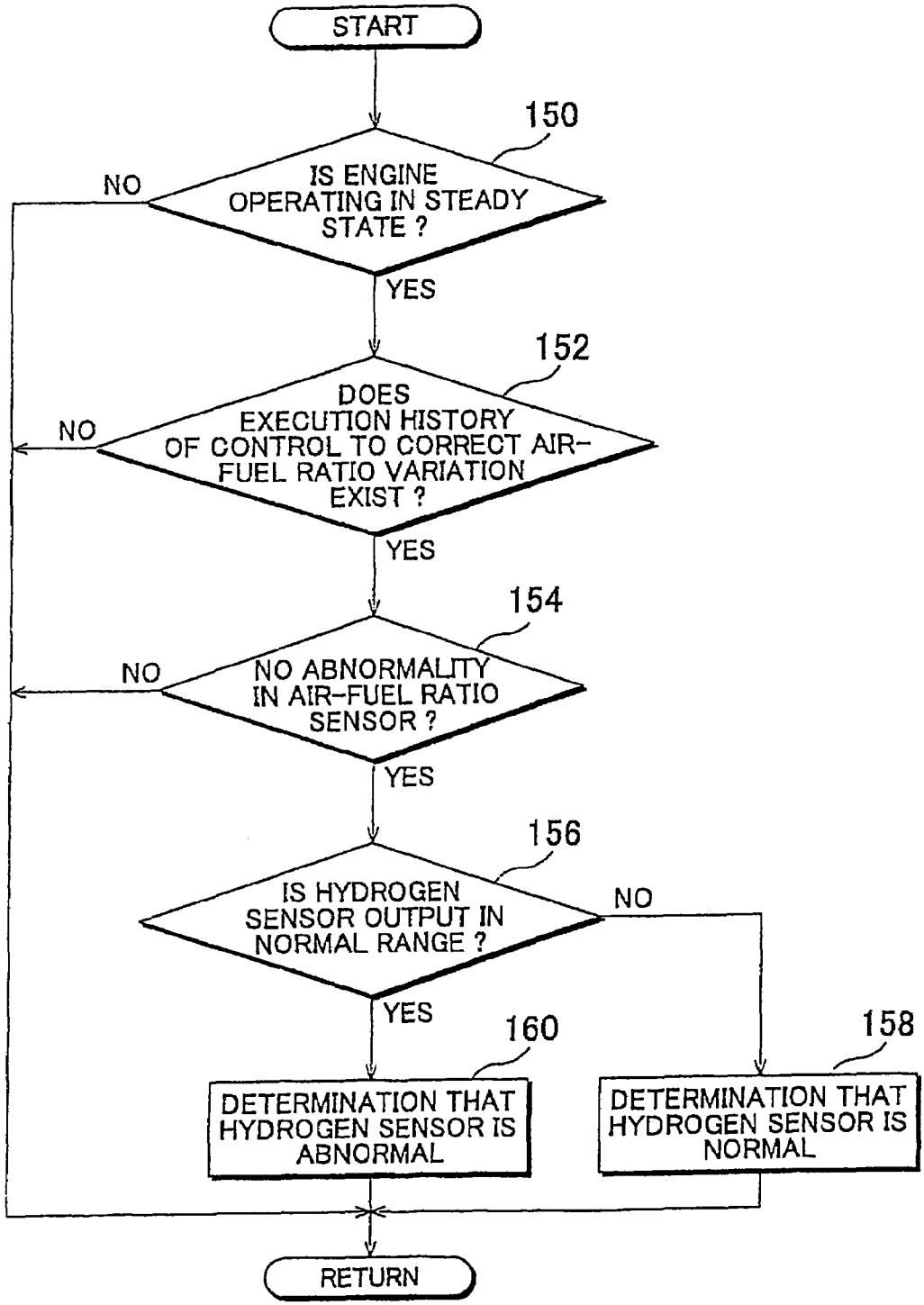
FIG. 10 is a flowchart illustrating a routine executed in a third embodiment of the routine.

FIG. 10 is a flowchart of a routine executed by the ECU 50 in this embodiment in order to realize the function described above. According to the routine shown in FIG. 10, it is first determined whether the internal combustion engine 10 is operating steadily (step 150). This determination may be made just as it was in step 100. During excessive operation of the into combustion engine 10, the hydrogen content in the exhaust gas tends to change instantaneously so this would not be an appropriate time to make a failure determination of the hydrogen sensor 46. Therefore, if it is determined in step 150 that the internal combustion engine 10 is not operating in a steady state, this cycle of the routine directly ends.

If, on the other hand, it is determined in step 100 that the internal combustion engine 10 is operating in a steady state, then it is next determined whether there is a history of recent execution of the control to correct air-fuel ratio variation between the cylinders (step 152). If there is no history of that control being executed recently, this cycle of the routine directly ends. If there is a history of that control being executed recently, the ECU 50 then checks to make sure that there is no failure in the air-fuel ratio sensor 44 (step 154).

If there is a failure in the air-fuel ratio sensor 44, the overall air-fuel ratio in this system is unable to be accurately detected so it is difficult to determined whether there is a failure in the hydrogen sensor 46. Therefore, if it is confirmed in step 154 that there is a failure in the air-fuel ratio sensor 44, this cycle of the routine directly ends.

Whether or not there is a failure in the air-fuel ratio sensor 44 can be detected by any one of various known methods. For example, it can be detected based on whether the output value is outside of a given range, based on a comparison with a sub air-fuel ratio sensor ($O_2$ sensor), or based on a decrease in responsiveness.

If it is confirmed in step 154 that there is no failure in the air-fuel ratio sensor 44, then it is next determined whether the output value of the hydrogen sensor 46 is within a normal range (step 156). More specifically, the engine speed NE, load factor, and control target air-fuel ratio are obtained as current operating conditions of the internal combustion engine 10 and a normal range for the output value of the hydrogen sensor 46 according to those operating conditions is obtained. Then it is determined whether the current output value of the hydrogen sensor 46 is within that normal range.

If it is determined in step 156 that the output value of the hydrogen sensor 46 is within the normal range, then the hydrogen sensor 46 is determined to be normal (step 158). If, on the other hand, the output value of the hydrogen sensor 46 is out of the normal range, then it is determined that the output sensor of the hydrogen sensor 46 (i.e., the hydrogen sensor 46 itself) is abnormal (step 160). If it is determined that the hydrogen sensor 46 is abnormal, the driver is preferably alerted to that fact and prompted to have to engine checked.

In the third embodiment described above, the process in step 156 may also be regarded as a "sensor failure determining portion".

Figure 11:
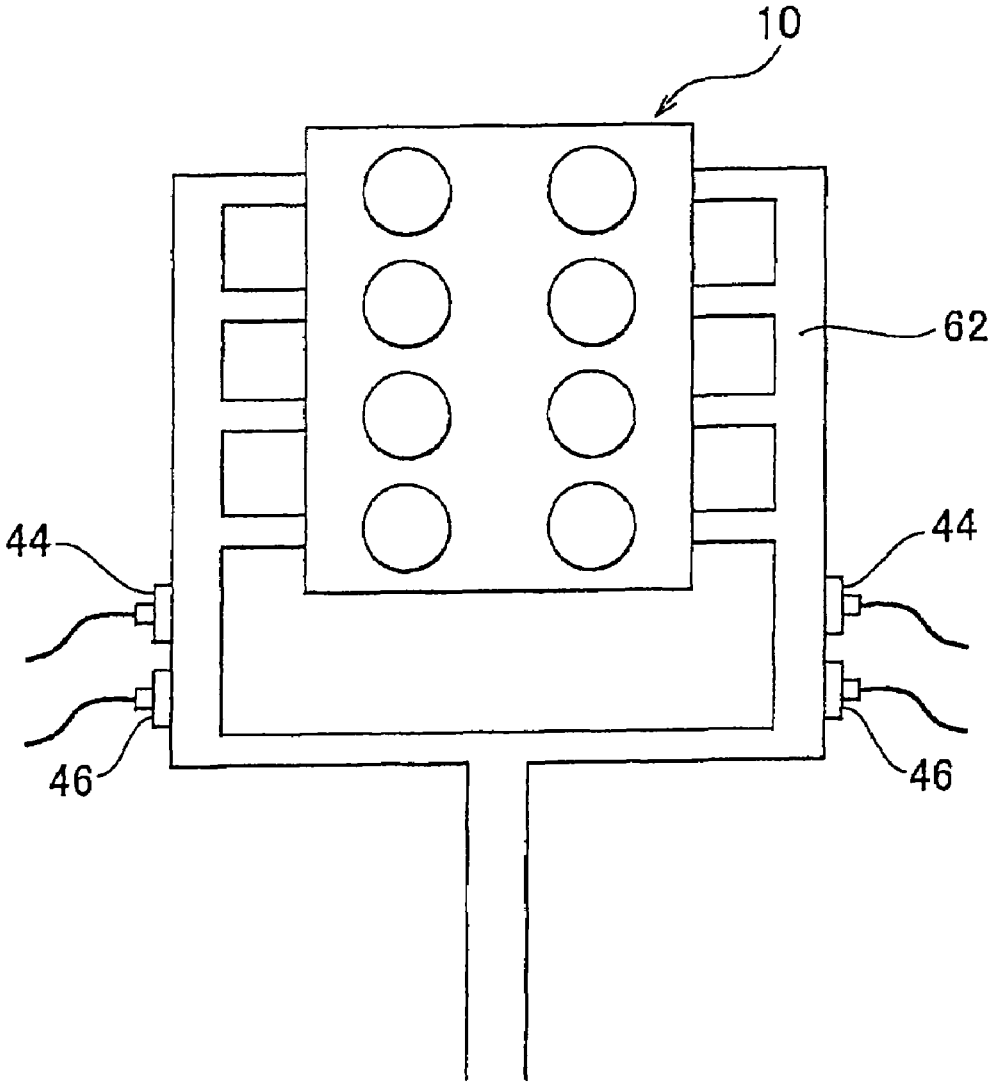
FIG. 11 is a plane view in frame format showing a V-type 8 cylinder internal combustion engine.

FIG. 11 is a plane view in frame format showing a V-type eight cylinder internal combustion engine 60. With a V-type engine such as this internal combustion engine 60, the exhaust manifold 62 is usually structured such that the exhaust passages from all of the cylinders of each bank first merge and then exhaust passages from both banks join together farther downstream. When employing the invention to such a V-type engine, the air-fuel ratio sensor 44 and the hydrogen sensor 46 may be arranged as a one set downstream of the portion where the exhaust passages from all of the cylinders merge, or as shown in FIG. 11, one set of the sensors, i.e., one air-fuel ratio sensor 44 and one hydrogen sensor 46, may be provided for each bank. In this case, the control of the invention described above may be performed for each bank.

In the above-described embodiments, the hydrogen content in the mixed exhaust gas is used as the index value relating to the actual hydrogen content, and directly detected by the hydrogen sensor. Based on the detected hydrogen content, it is determined whether the air-fuel ratio variation between the cylinders is abnormal air-fuel ratio variation. However, the index value relating to the actual hydrogen content according to the invention is not limited to the hydrogen content detected by the hydrogen sensor. The index value relating to the actual hydrogen content according to the invention may be a detected value correlated with the actual hydrogen content. For example, the index value relating to the actual hydrogen content may be calculated based on a detected value in (1) or (2) described below.

(1) A response period of the air-fuel ratio sensor 44 when the air-fuel ratio is actively controlled (2) A deviation of a value detected by the downstream air-fuel ratio sensor 47 toward a lean side from a value detected by the air-fuel ratio sensor 44

The section (1) will be described. The index value relating to the actual hydrogen content may be calculated based on the response period of the air-fuel ratio sensor 44 when the air-fuel ratio of the air-fuel mixture in the combustion chamber is actively controlled (i.e., an active air-fuel ratio control is executed). In Japanese Patent Application No. 2007-180283 filed by the applicant of the present application, the index value calculated based on the response period is described. In Japanese Patent Application No. 2007-180283, "the index value relating to the actual hydrogen content" is referred to as "information relating to a hydrogen concentration level". When the hydrogen concentration level is equal to or higher than a predetermined value (i.e., a determination value corresponding to a permissible limit of air-fuel ratio variation between the cylinders), it is determined that there is abnormal air-fuel ratio variation between the cylinders. Hereinafter, the technology described in Japanese Patent Application No. 2007-180283 will be described.

Figure 12:
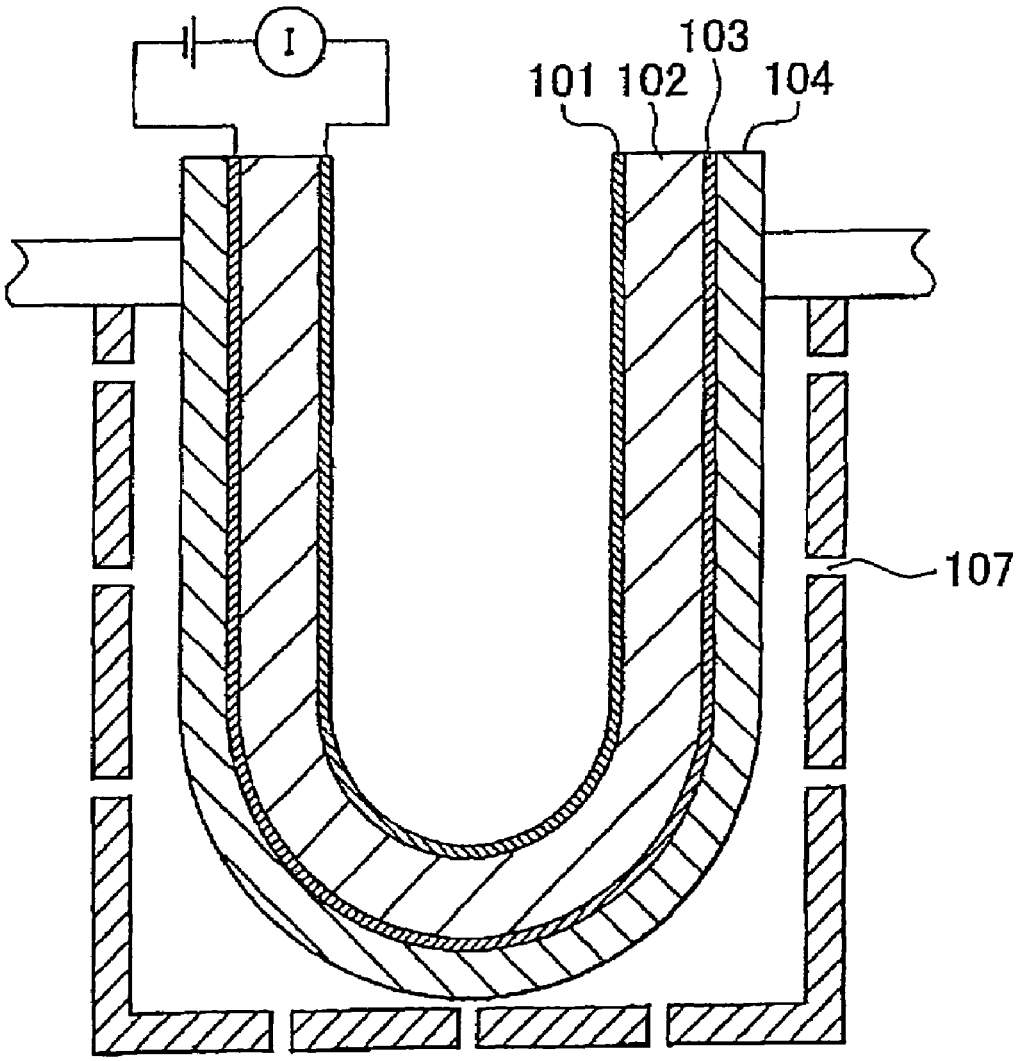
FIG. 12 is a schematic diagram showing an air-fuel ratio sensor including a sensor element.

FIG. 12 is a schematic diagram showing an air-fuel ratio sensor 44. In FIG. 12, an outer electrode 103, an inner electrode 101, an oxygen ion conductive solid electrolyte 102, and a porous layer 104 are shown. The pressure of exhaust gas applied to the outer electrode 103 is made substantially equal to an atmospheric pressure by a vent hole 107. Therefore, the air-fuel ratio sensor 44 detects an oxygen content using an electric current or a voltage between the outer electrode 103 and the inner electrode 101, which is generated based on a difference in oxygen partial pressure between the outer electrode 103 and the inner electrode 101.

Figures 13A, 13B, 13C:
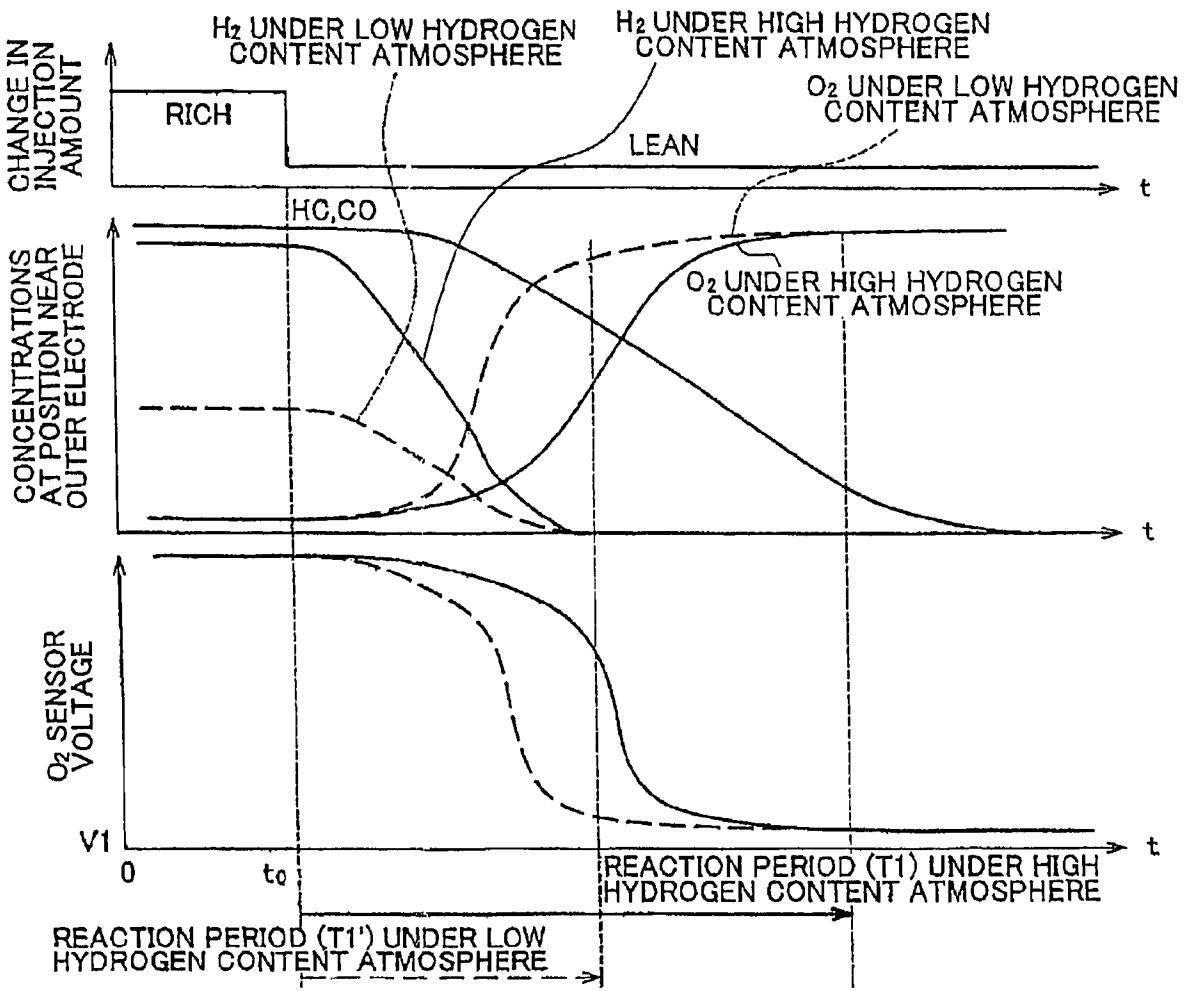
FIGS. 13A to 13C are diagrams showing a time-series change in concentrations of components at a position near an outer electrode in the air-fuel ratio sensor, and a time-series change in a voltage in an $O_2$ sensor, when air-fuel ratio control means changes a target air-fuel ratio from a rich air-fuel ratio to a lean air-fuel ratio.

The response of the air-fuel ratio sensor when the air-fuel ratio changes from a rich air-fuel ratio to a lean air-fuel ratio FIG. 13B is a schematic diagram showing a time-series change in concentrations of components in the porous layer 104 at a position near the outer electrode 103. FIG. 13C is a diagram showing a time-series change in an electromotive force voltage generated between the both electrodes of the air-fuel ratio sensor 44. The solid line indicates the case where the hydrogen content in the exhaust gas is high (hereinafter, referred to as "high hydrogen content atmosphere"). The dashed line indicates the case where there is almost no hydrogen in the exhaust gas (hereinafter, referred to as "low hydrogen content atmosphere").

In FIG. 13B, when a target air-fuel ratio is a rich air-fuel ratio (A/F value 14) before a time point $t_0$ ($t<t_0$), there are hydrogen $H_2$, methane $CH_4$, hydrocarbon HC, and carbon monoxide CO in the exhaust gas at the position near the outer electrode 13 in the air-fuel ratio sensor 44. At this time, the oxygen partial pressure at the outer electrode 103 is lower than the oxygen partial pressure at the inner electrode 101. Thus, a positive electromotive force is generated (refer to FIG. 13C), and a negative electric current is generated.

As shown in FIG. 13A, at the time point $t_0$ ($t=t_0$), air-fuel ratio control means changes the target air-fuel ratio from a rich air-fuel ratio (A/F value 14) to a lean air-fuel ratio (A/F value 15). Then, the amount of injected fuel is changed, and the characteristic of combustion is changed. As the time elapses, the content of hydrocarbon HC and the content of carbon monoxide CO in the exhaust gas gradually decrease, and the content of oxygen $O_2$ in the exhaust gas increases. Then, the exhaust gas, whose components have been changed, flows out from a combustion chamber, and reaches the outer electrode 103 in the air-fuel ratio sensor 44. Under the high hydrogen content atmosphere, hydrogen $H_2$ near the outer electrode 103 reacts with oxygen $O_2$ ($O_2+2H_2 \rightarrow 2H_2O$), and thus, oxygen $O_2$ is consumed. A high oxygen content reaction period (T1) is a period from the time point $t_0$ ($t=t_0$) at which the air-fuel ratio control means changes the target air-fuel ratio from a rich air-fuel ratio to a lean air-fuel ratio until a time point at which an electromotive force V1 indicating a lean air-fuel ratio (A/F value 15) is generated. As shown FIG. 13C, the high oxygen content reaction period (T1) under the high hydrogen content atmosphere is longer than the high oxygen content reaction period (T1') under the low hydrogen content atmosphere.

Figures 14A, 14B, 14C:
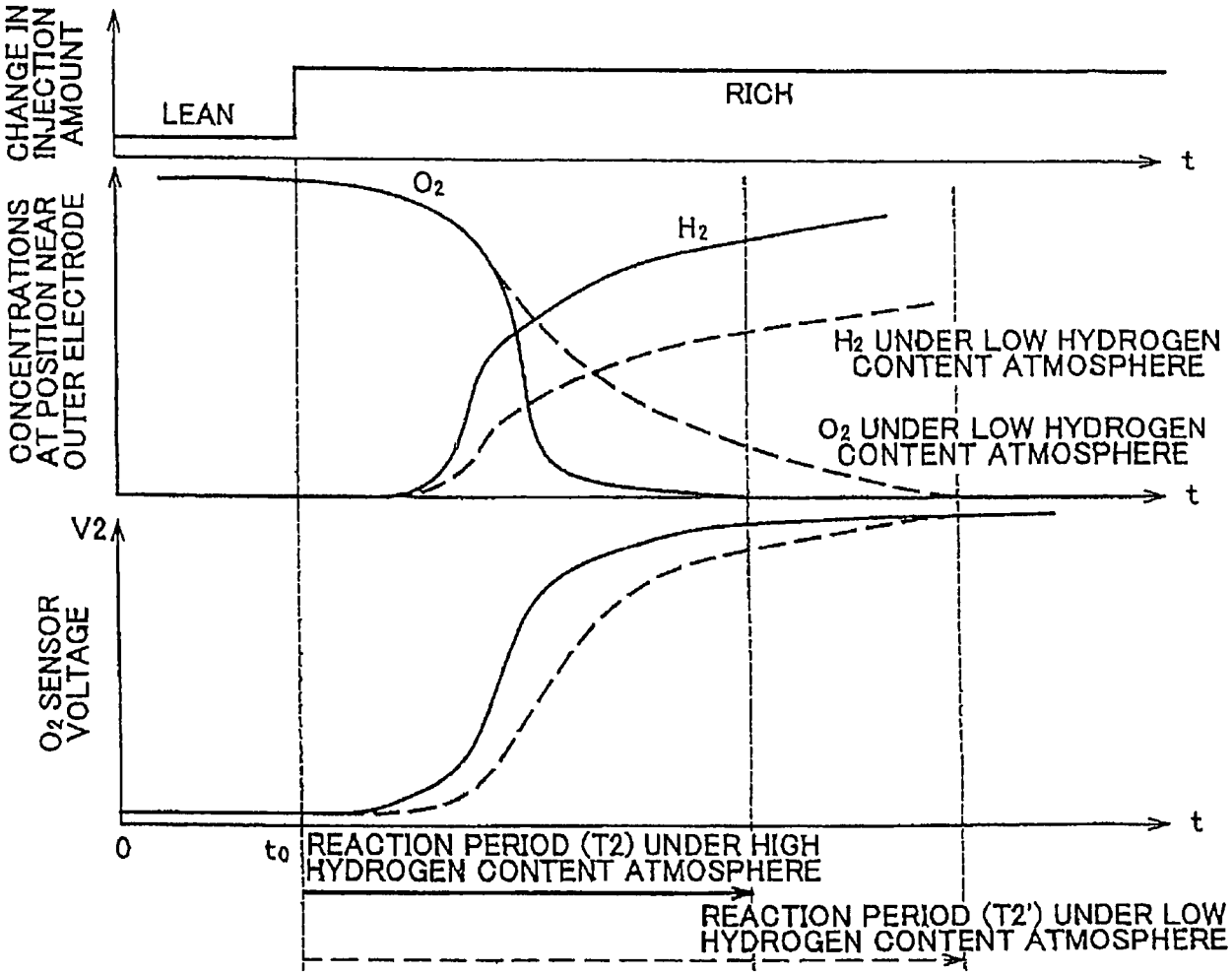
FIGS. 14A to 14C are diagrams showing a time-series change in the concentrations of components at the position near the outer electrode in the air-fuel ratio sensor, and a time-series change in the voltage in the $O_2$ sensor, when the air-fuel ratio control means changes the target air-fuel ratio from a lean air-fuel ratio to a rich air-fuel ratio.

The response of the air-fuel ratio sensor to the air-fuel ratio control that changes the air-fuel ratio from a lean air-fuel ratio to a rich air-fuel ratio In FIGS. 14A to 14C, the solid line indicates the case where the atmosphere is the high hydrogen content atmosphere, and the dashed line indicates the case where the atmosphere is the low hydrogen content atmosphere. As shown in FIG. 14C, the low oxygen content reaction period (T2) under the high hydrogen content atmosphere is shorter than the low oxygen content reaction period (T2') under the low hydrogen content atmosphere.

Figure 18:
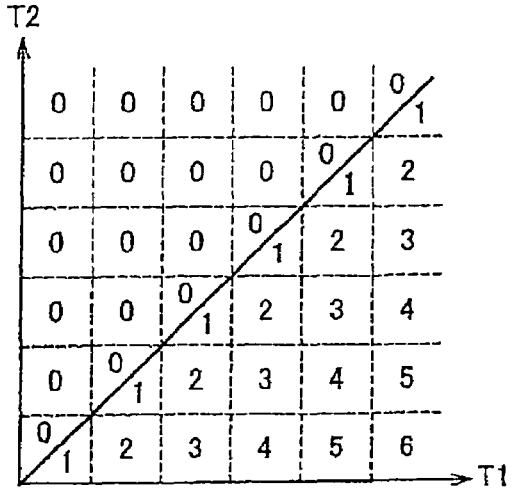
FIG. 18 is a map used to determined T (map) based on T1 and T2.

Principle of a hydrogen detection device that includes the air-fuel ratio sensor and the air-fuel ratio control means As described above, when the atmosphere is the high hydrogen content atmosphere, the high oxygen content reaction period (T1) is long, and the low oxygen content reaction period (T2) is short, as compared to when the atmosphere is the low hydrogen content atmosphere. Using this, a detection portion detects information relating to the hydrogen concentration level. The detection portion detects both of the high oxygen content reaction period (T1) and the low oxygen content reaction period (T2), and determines a difference (asymmetricity) between the periods. That is, T (div)=(high oxygen content reaction period)/(low oxygen content reaction period)=T1/T2 is calculated, and T (div) is regarded as the hydrogen concentration level. In the embodiment, the ratio T (div) is regarded as the hydrogen concentration level. However, a difference T (dif)=(high oxygen content reaction period)−(low oxygen content reaction period)=T1−T2 may be calculated, and the difference T (dif) may be regarded as the hydrogen concentration level. In another example, an experiment may be conducted in advance to obtain a corresponding relation between the high oxygen content reaction period/low oxygen content reaction period, and the hydrogen concentration level, a map shown in FIG. 18 may be stored, and the hydrogen concentration level may be determined based on the map. T (map)=Map (high oxygen content reaction period), (low oxygen content reaction period))

Figure 15:
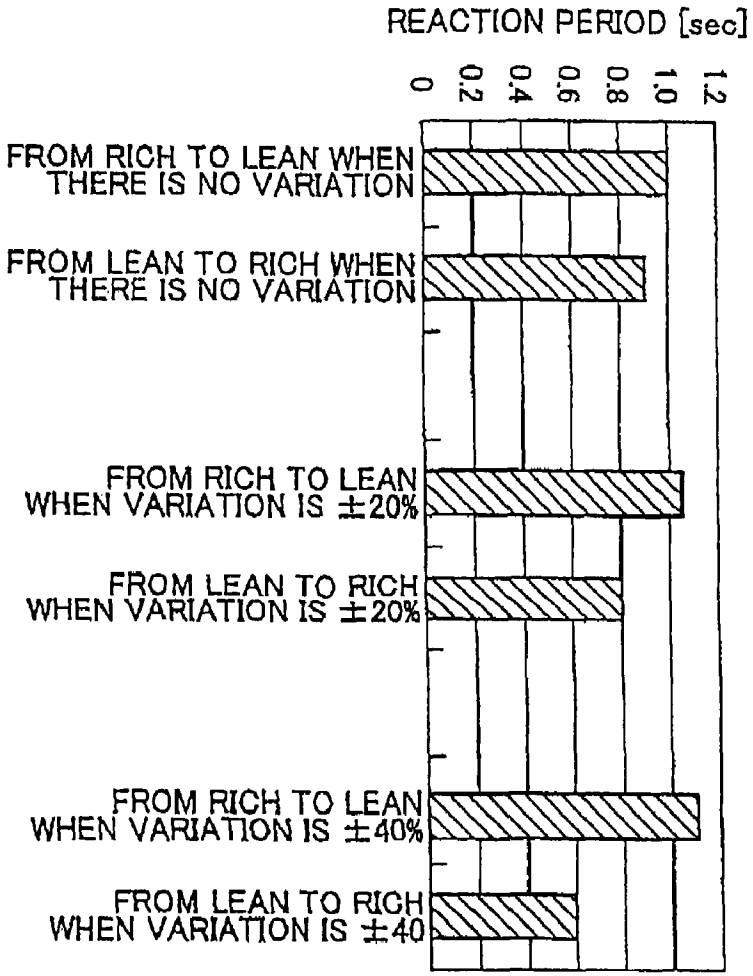
FIG. 15 is a diagram showing reaction periods of the air-fuel ratio sensor when there is variation between cylinders and when there is not variation between cylinders.
Figure 16:
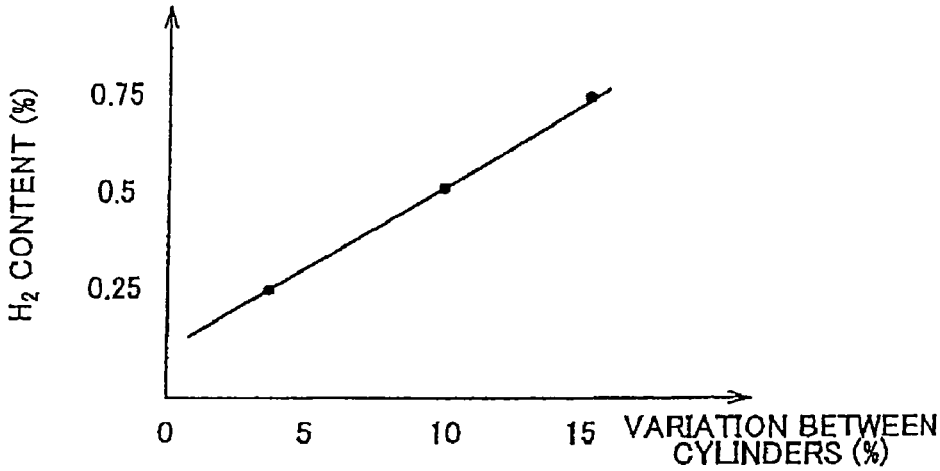
FIG. 16 is a diagram showing a relation between the degree of the variation between the cylinders (%) and a hydrogen content.
Figure 17:
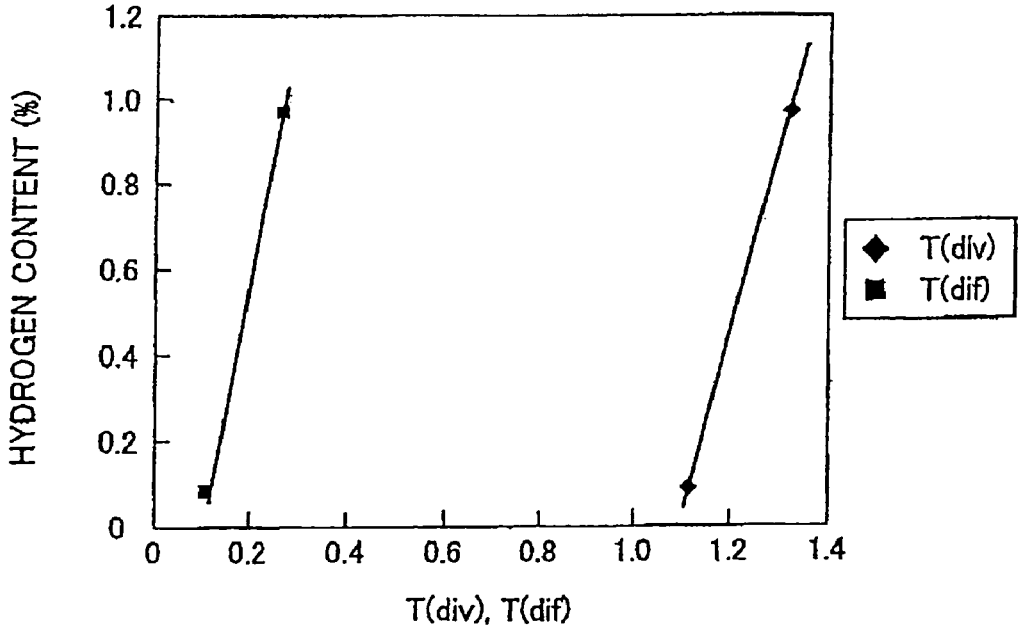
FIG. 17 is a diagram showing a relation between the hydrogen content and T (div) or T (dif)

Specific numeric data relating to T (div) or T (dif) is shown. As described later, variation between cylinders is correlated with the hydrogen content (%) as shown in FIG. 16. The hydrogen content (%) in FIG. 16 is the data on values detected by a hydrogen sensor that is different from the hydrogen sensor 46. FIG. 15 is the data showing the low oxygen content reaction period and the high oxygen content reaction period detected according to the degree of the variation between the cylinders. The hydrogen content when the variation between the cylinders is 0%, and the hydrogen content when the variation between the cylinders is 20%, which are estimated based on FIG. 15 and FIG. 16, are 0.08% and 0.98%, respectively. FIG. 17 shows a relation between the hydrogen content and T (div) or T (dif). In FIG. 17, the relation between the hydrogen content and T (div) or T (dif) is approximated by the straight line, and it is estimated that there is a proportional relation between the hydrogen content and T (div) or T (dif). However, the experiment may be conducted a plurality of times to increase the number of samples, and the relation between the hydrogen content and T (div) or T (dif) may be approximated by a curve. An experiment may be conducted and a map may be stored in advance to define the relation between the hydrogen content and T (div) or T (dif). The relation between the hydrogen content and T (div) or T (dif) is appropriately changed according to an initial condition of an air-fuel ratio sensor that is used.

An experiment may be conducted in advance to obtain the corresponding relation between the high oxygen content reaction period/the low oxygen content reaction period and the hydrogen content, the map may be stored, and the hydrogen content may be determined based on the map. Hydrogen content (%)=Map2 (high oxygen content reaction period), (low oxygen content reaction period))

In another example of the embodiment, the values of the electromotive forces V1 indicating a lean air-fuel ratio and V2 indicating a rich air-fuel ratio (A/F value 14) may be appropriately changed. An electromotive force V1' may be set to a value that is between V1 and V0 (0.5 volt), and that is sufficiently close to V1, and the high oxygen content reaction period T1 may be defined as a period from the time point $t_0$ ($t=t_0$) until a time point at which the electromotive force V1' is generated in the air-fuel ratio sensor. An electromotive force V2' may be set to a value that is between V2 and V0 (0.5 volt), and that is sufficiently close to V2, and the low oxygen content reaction period T2 may be defined as a period from the time point $t_0$ ($t=t_0$) to a time point at which the electromotive force V2' is generated in the air-fuel ratio sensor.

In another example of the embodiment, the time point at which the measurement of T1 is started and the time point at which the measurement of T2 is started may be appropriately changed. The high oxygen content reaction period T1 may be defined as a period from a time point after the time point $t_0$, for example, a time point at which the air-fuel ratio sensor detects a voltage (0.5 volt) corresponding to the stoichiometric air-fuel ratio, until a time point at which the air-fuel ratio sensor detects the voltage V1. The low oxygen content reaction period T2 may be defined as a period from a time point after the time point $t_0$, for example, a time point at which the air-fuel ratio sensor detects the voltage (0.5 volt) corresponding to the stoichiometric air-fuel ratio, until a time point at which the air-fuel ratio sensor detects the voltage V2.

The section (2) will be described. The index value relating to the actual hydrogen content may be calculated based on the deviation of the value detected by the downstream air-fuel ratio sensor 47 toward the lean side from the value detected by the air-fuel ratio sensor 44 when the air-fuel ratio feedback control is being executed. In Japanese Patent Application No. 2007-192474 filed by the applicant of the present application, the index value calculated based on the deviation is described. In Japanese Patent Application No. 2007-192474, "the index value relating to the actual hydrogen content" is referred to as "the deviation of the value detected by the downstream air-fuel ratio sensor 47 toward the lean side from the value detected by the air-fuel ratio sensor 44". Hereinafter, the technology described in Japanese Patent Application No. 2007-192474 will be described.

A main air-fuel ratio feedback control is executed to make a first air-fuel ratio detected by the air-fuel ratio sensor 44 equal to the stoichiometric air-fuel ratio.

A subsidiary air-fuel ratio feedback control is executed to make a second air-fuel ratio detected by the downstream air-fuel ratio sensor 47 equal to the stoichiometric air-fuel ratio.

In the main air-fuel ratio feedback control, the first air-fuel ratio of the entire exhaust gas discharged from all the cylinders is detected, and the first air-fuel ratio is controlled to the stoichiometric air-fuel ratio. Therefore, it is not possible to detect air-fuel ratio variation between the cylinders, based on a correction amount in the main air-fuel ratio feedback control. That is, even when there is air-fuel ratio variation between the cylinders, if an amount of deviation of the air-fuel ratio of the entire exhaust gas discharged from all the cylinders is zero, the correction amount is zero. Thus, it seems as if the main air-fuel ratio feedback control were normally executed without problem.

When there is air-fuel ratio variation between the cylinders, the amount of hydrogen is large, and an output Vf from the air-fuel ratio sensor 44 deviates toward a rich side, as compared to when the air-fuel ratio of the entire exhaust gas discharged frog all the cylinders deviates. Using this characteristic, abnormal air-fuel ratio variation between the cylinders is detected in the manner described below.

When the exhaust gas containing hydrogen passes through a catalyst, the hydrogen in the exhaust gas is oxidized (burned) and removed. The air-fuel ratio sensor 44 detects the air-fuel ratio of the exhaust gas which has not passed through the catalyst, and whose hydrogen has not been removed, that is, the first air-fuel ratio. The downstream air-fuel ratio sensor 47 detects the air-fuel ratio of the exhaust gas which has passed through the catalyst, and whose hydrogen has been removed, that is, the second air-fuel ratio. The detected first air-fuel ratio deviates from the detected second air-fuel ratio toward the rich side, due to influence of hydrogen. In other words, the detected second air-fuel ratio deviates from the detected first air-fuel ratio toward the lean side, due to the influence of hydrogen. Thus, abnormal air-fuel ratio variation between the cylinders is detected based on the deviation of the second air-fuel ratio from the first air-fuel ratio toward the lean side.

More specifically, the detected second air-fuel ratio after hydrogen is removed is a true air-fuel ratio. The detected first air-fuel ratio before hydrogen is removed is an air-fuel ratio that seems to deviate toward the rich side from the true air-fuel ratio due to the influence of hydrogen. In other words, the air-fuel ratio sensor 44 is deceived. The amount of hydrogen increases in a quadratic-function manner, according to an increase in the amount of deviation of the air-fuel ratio in a part of the cylinders toward the rich side from the air-fuel ratio in the rest of the cylinders. Thus, when the detected first air-fuel ratio greatly deviates toward the rich side from the detected second air-fuel ratio, that is, when the detected second air-fuel ratio greatly deviates toward the lean side from the detected first air-fuel ratio, it can be determined that there is abnormal air-fuel ratio variation between the cylinders.

Figure 19A:
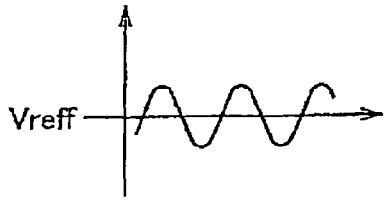
FIGS. 19A and 19B are diagrams showing a first air-fuel ratio and a second air-fuel ratio that are detected.

For example, a malfunction may occur in the injector for the cylinder #1, and therefore, the air-fuel ratio in the cylinder #1 may greatly deviate toward the rich side from the air-fuel ratio in the other cylinders #2 to #4. In this case, because the main air-fuel ratio feedback control is executed, the air-fuel ratio of the entire exhaust gas obtained by joining together the flows of exhaust gas discharged from all the cylinders is controlled to a value near the stoichiometric air-fuel ratio as shown in FIG. 19A. That is, the output Vf from the air-fuel ratio sensor 44 is close to an output Vreff corresponding to the stoichiometric air-fuel ratio. However, the air-fuel ratio in the cylinder #1 is much richer than the stoichiometric air-fuel ratio, the air-fuel ratio in the cylinders #2 to #4 is leaner than the stoichiometric air-fuel ratio, and the air-fuel ratio of the entire exhaust gas discharged from all the cylinders is close to the stoichiometric air-fuel ratio due to the balance between the air-fuel ratio in the cylinder #1 and the air-fuel ratio in the cylinders #2 to #4. Further, because a large amount of hydrogen is generated in the cylinder #1, the output Vf from the air-fuel ratio sensor 44 erroneously indicates the air-fuel ratio that deviates toward the rich side from the true air-fuel ratio, that is, the stoichiometric air-fuel ratio.

Figure 19B:
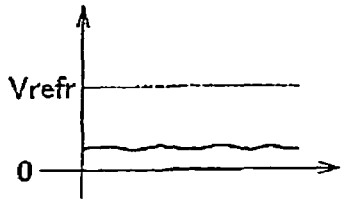

When the exhaust gas containing hydrogen passes through the catalyst 11, hydrogen is removed, and the influence of hydrogen is eliminated. Accordingly, as shown in FIG. 19B, the output Vr from the downstream air-fuel ratio sensor 47 indicates the true air-fuel ratio, that is, the air-fuel ratio leaner than the stoichiometric air-fuel ratio. That is, the output Vr from the downstream air-fuel ratio sensor 47 is a value leaner than the output Vrefr corresponding to the stoichiometric air-fuel ratio.

Thus, when the downstream air-fuel ratio sensor 47 detects the second air-fuel ratio leaner than the stoichiometric air-fuel ratio for a predetermined period or longer although the first air-fuel ratio is controlled to the stoichiometric air-fuel ratio by the main air-fuel ratio feedback control (that is, the output from the air-fuel ratio sensor 47 continues to be a lean value), it is determined that there is abnormal air-fuel ratio variation between the cylinders. That is, as the hydrogen content in the exhaust gas becomes higher, the output Vr from the air-fuel ratio sensor 47 continues to be a value leaner than the output Vrefr corresponding to the stoichiometric air-fuel ratio for a longer period. Therefore, the period in which the output Vr from the air-fuel ratio sensor 47 continues to be a value-leaner than the output Vrefr corresponding to the stoichiometric air-fuel ratio can be regarded as the index value relating to the hydrogen content. It is considered that the air-fuel ratio upstream of the catalyst differs from the air-fuel ratio downstream of the catalyst because a significantly large amount of hydrogen is generated due to a malfunction, for example, in the injector for a part of the cylinders.

When the downstream air-fuel ratio sensor 47 detects the lean air-fuel ratio, a rich correction is performed by the subsidiary air-fuel ratio feedback control. Thus, the amounts of fuel injected for all the cylinders are uniformly increased. As a result, the detected first air-fuel ratio further deviates toward the rich side, and the second air-fuel ratio is maintained at a lean value. Eventually, the correction amount in the main air-fuel ratio feedback control and the correction amount in the subsidiary air-fuel ratio feedback control converge to values corresponding to the degree of the abnormal variation.

While the invention has been described with reference to embodiments thereof, it is to be understood that the invention is not limited to the embodiments or constructions. To the contrary, the invention is intended to cover various modifications and equivalent arrangements. In addition, while the various elements of the embodiments are shown in various combinations and configurations, which are exemplary, other combinations and configurations, including more, less or only a single element, are also within the spirit and scope of the invention.

The invention claimed is:

1. An air-fuel ratio control apparatus of an internal combustion engine, comprising:

a hydrogen detection device that is arranged downstream of a portion where exhaust passages from a plurality of cylinders merge, and that detects an index value relating to an actual hydrogen content in exhaust gas; and a determination portion that determines whether air-fuel ratio variation between the cylinders is abnormal air-fuel ratio variation, by comparing the index value relating to the actual hydrogen content, with a determination index value relating to a hydrogen content corresponding to a permissible limit of the air-fuel ratio variation between the cylinders.

2. The air-fuel ratio control apparatus of an internal combustion engine according to claim 1, wherein the hydrogen detection device detects the index value relating to the actual hydrogen content in the exhaust gas in an area downstream of the portion where the exhaust passages from the cylinders merge, and upstream of a catalyst.

3. An air-fuel ratio control apparatus of an internal combustion engine, comprising:

a detection device that is arranged downstream of a portion where exhaust passages from a plurality of cylinders merge, and that detects a first sensor value in exhaust gas; and a determination portion that determines whether air-fuel ratio variation between the cylinders is abnormal air-fuel ratio variation, by comparing an index value relating to the actual hydrogen content calculated based on the first sensor value, with a determination index value relating to a hydrogen content corresponding to a permissible limit of the air-fuel ratio variation between the cylinders.

4. The air-fuel ratio control apparatus of an internal combustion engine according to claim 3, wherein the detection device detects a second sensor value in the exhaust gas in an area downstream of a catalyst and the index value relating to the actual hydrogen content is calculated based on the first and second sensor values.

* * * * *

UNITED STATES PATENT AND TRADEMARK OFFICE

CERTIFICATE OF CORRECTION

PATENT NO. : 7,597,091 B2
APPLICATION NO. : 12/213064
DATED : October 6, 2009
INVENTOR(S) : Yusuke Suzuki et al.

It is certified that error appears in the above-identified patent and that said Letters Patent is hereby corrected as shown below:

On the Title Page in Section (30)

Please replace the Foreign Application Priority Data

Dec. 8, 2005 (JP) ……..2005-354450
Jul. 9, 2007 (JP) ……..2007-180283
Jul. 24, 2007 (JP) ……..2007-192474 with

Dec. 8, 2005 (JP) ……..2005-354540
Jul. 9, 2007 (JP) ……..2007-180283
Jul. 24, 2007 (JP) ……..2007-192474

Signed and Sealed this

Twelfth Day of January, 2010

David J. Kappos

David J. Kappos
*Director of the United States Patent and Trademark Office*